US012514385B2

(12) United States Patent
Eget et al.

(10) Patent No.: US 12,514,385 B2
(45) **Date of Patent: *Jan. 6, 2026**

(54) DISPLAY CASE WITH INSULATED FOAM PANELING

(71) Applicant: Hill Phoenix, Inc., Conyers, GA (US)

(72) Inventors: Larry William Eget, Midlothian, VA (US); Steven O. Stubblefield, Mechanicsville, VA (US); Nicholas Jeffers, Lexington, MA (US); Daniela Guadalupe Medina, Pinehurst, TX (US)

(73) Assignee: Hill Phoenix, Inc., Conyers, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/644,484

(22) Filed: Apr. 24, 2024

(65) Prior Publication Data

US 2024/0277161 A1 Aug. 22, 2024

Related U.S. Application Data

(63) Continuation of application No. 17/457,789, filed on Dec. 6, 2021, now Pat. No. 11,980,300.

(60) Provisional application No. 63/123,875, filed on Dec. 10, 2020, provisional application No. 63/122,438, filed on Dec. 7, 2020.

(51) Int. Cl.
*A47F 3/04* (2006.01)

(52) U.S. Cl.
CPC ..... *A47F 3/0469* (2013.01)

(58) Field of Classification Search
CPC ..... A47F 3/0469; F25D 23/066
See application file for complete search history.

(56) References Cited

U.S. PATENT DOCUMENTS 10,471,626 B1 11/2019 Dumuk et al.
11,980,300 B2 5/2024 Eget et al.
(Continued)

FOREIGN PATENT DOCUMENTS

GB 2081335 2/1982
GB 2081335 A * 2/1982 ..... E04H 1/125
(Continued)

OTHER PUBLICATIONS

Office Action in Mexican Appln. No. MX/a/2021/015117, mailed on May 2, 2025, 10 pages (with English translation).

*Primary Examiner* — Matthew W Ing
(74) *Attorney, Agent, or Firm* — Fish & Richardson P.C.

(57) ABSTRACT

A refrigerated display case chassis includes a first insulated panel and a second insulated panel. The first insulated panel has a first foam layer bounded by a first pair of thermally conductive sheets. The first insulated panel forms a first wall of the refrigerated display case chassis. The second insulated panel has a second foam layer bounded by a second pair of thermally conductive sheets. The second insulated panel forms a second wall of the refrigerated display case chassis. The second insulated panel mates with the first insulated panel to form a thermally insulated joint where, in cross-section, one sheet of the first pair of thermally conductive sheets terminates at a surface of the second foam layer. The thermally conductive sheets have a greater thermal conductivity than the first or second foam layers.

13 Claims, 19 Drawing Sheets

(56) References Cited

U.S. PATENT DOCUMENTS

| | | | | |
|---|---|---|---|---|
| 2011/0162403 | A1* | 7/2011 | Selin | F25D 23/063 62/449 |
| 2013/0213074 | A1 | 8/2013 | Nguyen et al. | |
| 2017/0007039 | A1 | 1/2017 | Resch | |
| 2018/0180350 | A1 | 6/2018 | Yoon et al. | |
| 2022/0175156 | A1 | 6/2022 | Eget et al. | |

FOREIGN PATENT DOCUMENTS

| | | |
|---|---|---|
| KR | 10-1999-0004868 | 2/1999 |
| KR | 10-2012-0004576 | 6/2012 |

* cited by examiner

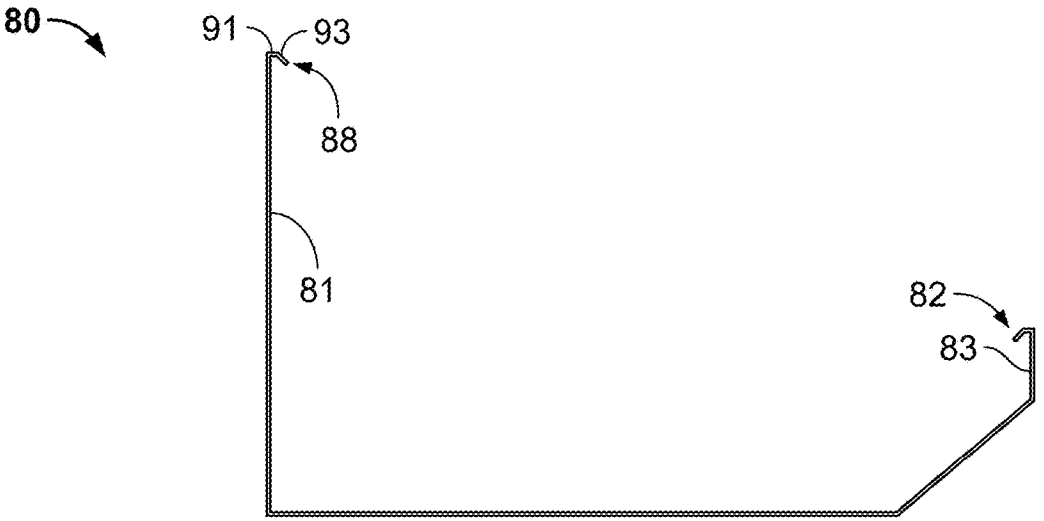
FIG. 11
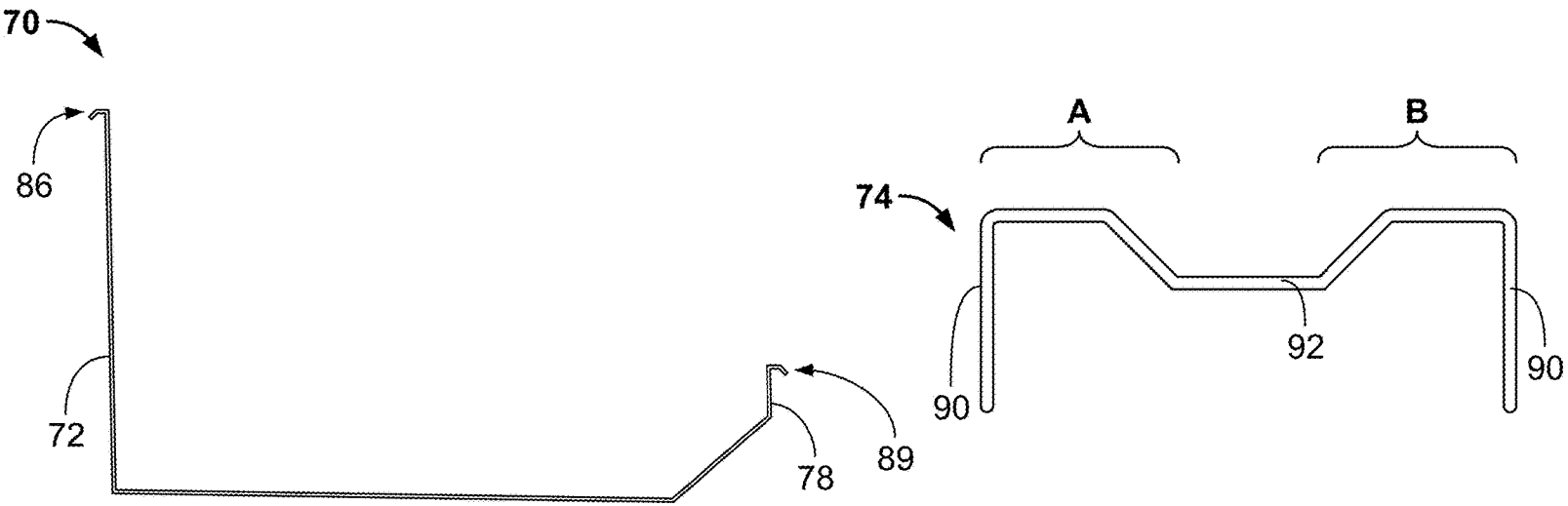
FIG. 12
FIG. 13

DISPLAY CASE WITH INSULATED FOAM PANELING

CROSS-REFERENCE TO RELATED APPLICATIONS

This application is a continuation application of and claims priority under 35 U.S.C. § 120 to U.S. application Ser. No. 17/457,789, filed on Dec. 6, 2021, now U.S. Pat. No. 11,980,300, which claims the benefit of the filing date of U.S. Provisional Application No. 63/122,438, filed on Dec. 7, 2020, and U.S. Provisional Application No. 63/123,875, filed on Dec. 10, 2020, the entire contents of each of which are incorporated herein by reference.

FIELD OF THE DISCLOSURE

This disclosure relates to refrigerated enclosures, and particularly to methods and equipment for manufacturing foam panels used in refrigerated display cases.

BACKGROUND OF THE DISCLOSURE

Refrigerated enclosures are used in commercial, institutional, and residential applications for storing and displaying refrigerated or frozen objects. Refrigerated enclosures may be maintained at temperatures above freezing (e.g., a refrigerator) or at temperatures below freezing (e.g., a freezer). The walls or casing of refrigerated enclosures can be made with foam panels of different shapes and dimensions. Improvements in the methods and systems for manufacturing refrigerated display foam panels are sought.

SUMMARY

Implementations of the present disclosure include a refrigerated display case chassis. The refrigerated display case chassis includes a first insulated panel and a second insulated panel. The first insulated panel has a first foam layer bounded by a first pair of thermally conductive sheets. The first insulated panel forms a first wall of the refrigerated display case chassis. The second insulated panel has a second foam layer bounded by a second pair of thermally conductive sheets. The second insulated panel forms a second wall of the refrigerated display case chassis. The second insulated panel mates with the first insulated panel to form a thermally insulated joint where, in cross-section, one sheet of the first pair of thermally conductive sheets terminates at a surface of the second foam layer. The thermally conductive sheets have a greater thermal conductivity than the first or second foam layers.

In some implementations, one sheet of the second pair of thermally conductive sheets terminates at a surface of one of the first thermally conductive sheets.

In some implementations, the joint includes a half-lap joint with the one sheet of the first pair of thermally conductive sheets terminating at an internal surface of the second foam layer.

In some implementations, the first insulating panel forms a back wall of the refrigerated display case chassis and the second insulating panel forms a top of the refrigerated display case chassis.

In some implementations, the first insulating panel forms a top of the refrigerated display case chassis and the second insulating panel forms a back wall of the refrigerated display case chassis.

In some implementations, the joint includes an upper corner of the refrigerated display case chassis.

In some implementations, the refrigerated display case chassis further includes a third insulated panel that has a third foam layer bounded by a third pair of thermally conductive sheets. The third insulated panel forms a base of the refrigerated display case chassis. The first insulated panel attaches to the third insulated panel to form a second joint. In some implementations, the third insulated panel includes, in a side view, a non-flat cross-section. In some implementations, the third insulated panel includes a frame extending along side edges of the third insulated panel and defining a volume containing the foam layer. At least part of the frame is bonded to the foam layer during curing of the foam layer. In some implementations, the frame includes a cap bracket that extends along the length of the third insulated panel. The upper sheet of the pair of thermally conductive sheets of the third insulated panel includes a first tab extending away from an upper end of the upper sheet toward a lower sheet of the pair of thermally conductive sheets. The lower sheet includes a second tab extending away from an upper end of the lower sheet toward the upper sheet such that the bracket overlaps at least one of the tabs to form a seal with the tabs. In some implementations, the frame includes end caps defining, in side view, a cross section corresponding with a non-flat cross-section of the pair of thermally conductive sheets. The non-flat cross-section of the thermally conductive sheets includes two vertical surfaces and a horizontal surface extending between and connecting the two vertical surfaces.

Implementations of the present disclosure also include an insulated case. The insulated case includes a first insulated panel and a second insulated panel. The first insulated panel forms a first wall of the insulated case and includes a first foam layer sandwiched between a first pair of liners. The first foam layer defines, in cross section, a first foam edge. The second insulated panel forms a second wall of the insulated case and includes a second foam layer sandwiched between a second pair of liners. The second foam layer defines, in cross section, a second foam edge configured to interface with the first foam edge of the insulated foam back panel to form a thermally insulated joint.

In some implementations, the first foam edge includes a first non-flat foam edge and the second foam edge includes a second non-flat foam edge corresponding with the first non-flat foam edge. One of the first or second non-flat foam edge is arranged to receive the other of the first or second non-flat foam edge.

In some implementations, the first wall includes a back or side wall of the insulated case and the second wall includes a ceiling of the insulated case, and the thermally insulated joint includes a corner. In some implementations, the insulated case also includes a bracket including a vertical surface and a horizontal support surface, the horizontal support surface configured to support, with the bracket attached to the first insulated panel, the second insulated panel.

In some implementations, the first and second insulated panels are arranged along a common plain and the first foam edge includes a flat foam edge and the second foam edge includes a flat foam edge corresponding with the first flat foam edge. In some implementations, the first foam edge extends beyond a first edge of the first pair of liners a first distance to form a male interface. The second foam edge is offset from a second edge of the second pair or liners a second distance equal to the first distance to form a female interface. The insulated joint includes a male-female connection with the first foam edge inserted into the second insulated panel and terminating at the second foam edge.

In some implementations, the insulated case also includes an insulated base including a forward end and a rearward end opposite the forward end. The first insulated panel attaches to the rearward end of the insulated base.

Implementations of the present disclosure also include a method of assembling an insulated display case. The method includes positioning a first insulated panel on a base of the insulated display case to form a first wall. The first insulated foam panel includes a first foam layer sandwiched between a first pair of thermally conductive sheets. The method also includes attaching a second insulated panel to the first insulated panel to form a second wall of the insulated display case. The second insulated panel includes a second foam layer sandwiched between a second pair of thermally conductive sheets. Attaching the second insulated panel to the first insulated panel includes forming a thermally insulated joint where, in cross-section, one sheet of the first pair of thermally conductive sheets terminates at a surface of the second foam layer.

In some implementations, the method also includes forming the first insulated panel by placing a first liner on a top surface of a lower press tool. Forming the first insulated panel also includes positioning a frame at a top surface of the first liner, the frame bordering a volume defined between the top surface of the first liner and an interior surface of the frame. The frame includes one of i) a movable frame attached to the lower press tool, the movable frame including a non-stick coating, or ii) brackets configured to be part of the foam panel. Forming the first insulated panel also includes depositing a liquid resin on the first liner within the volume. The liquid resin contains a foaming agent that causes the liquid resin to expand within the volume such that the resin bonds to the top surface of the first liner. Forming the first insulated panel also includes pressing a second liner against the frame. The second liner overlays the first liner while the liquid resin expands and solidifies into a foam between and bonded to the first liner and the second liner.

Implementations of the present disclosure also include a method of forming a foam panel for a refrigerated assembly. The method includes placing a first liner on a top surface of a lower press tool. The method also includes positioning a frame at a top surface of the first liner. The frame borders a volume defined between the top surface of the first liner and an interior surface of the frame. The frame includes one of i) a movable frame attached to the lower press tool, the movable frame including a non-stick coating, or ii) brackets configured to be part of the foam panel. The method also includes depositing a liquid resin on the first liner within the volume, the liquid resin containing a foaming agent that causes the liquid resin to expand within the volume such that the resin bonds to the top surface of the first liner. The method also includes pressing a second liner against the frame. The second liner overlays the first liner while the liquid resin expands and solidifies into a foam between and bonds to the first liner and the second liner.

In some implementations, the frame includes a movable frame. The movable frame includes two longitudinal rails that extend parallel with respect to each other and two lateral rails that reside between the longitudinal rails and extend in a direction perpendicular with respect to the two longitudinal rails. At least one of the lateral rails is movable along a length of the longitudinal rails, changing a distance between the lateral rails and thereby changing a length of the volume defined by the frame. Positioning the frame on the top surface of the first liner includes placing the longitudinal rails and the lateral rails on the top surface of the first liner, forming a squared-shaped or a rectangular-shaped frame.

In some implementations, the method further includes, after pressing the second liner, removing the longitudinal rails and the lateral rails away from the foam, exposing the foam between the first liner and the second liner.

In some implementations, the frame is configured to move away from the top surface of the lower press tool to accommodate a thickness of the first liner. The lower press tool includes multiple actuators, at least one actuator of the plurality of actuators is connected to a respective rail and configured to move the respective rail. The method further including, before placing the first liner on the top surface of the lower press tool, moving the rails and making room for the first liner to be placed on the top surface of the lower press tool.

In some implementations, the frame includes the brackets configured to be part of the foam panel and the first liner includes a non-flat sheet-form liner. The method further includes placing two substantially straight longitudinal brackets on the first liner. The longitudinal brackets extend parallel to each other. The method also includes placing two lateral, non-flat brackets on the first liner with the lateral brackets extending between the longitudinal brackets and connecting opposite ends of the longitudinal brackets.

In some implementations, the upper press tool and the lower press tool each includes one or more vacuum channels at their respective surfaces. The vacuum channels are configured to flow air forming a suction effect thereby gripping a respective one of the first or second liner.

In some implementations, placing the first liner on the top surface of the lower press tool includes placing, by a robotic arm including an end of arm tool, the first liner. The end of arm tool includes a longitudinal frame and vacuum cups attached to the frame. The vacuum cups grip the first liner and release the first liner on the top surface of the lower press tool.

Implementations of the present disclosure include a manufacturing assembly that includes a nozzle and a press. The press includes a lower press tool including a top surface configured to support a first liner and including a frame configured to be supported on a top surface of the first liner. The frame borders a volume defined between the top surface of the first liner and an interior surface of the frame, the frame including one of 1) a movable frame attached to the lower press tool, the movable frame including a non-stick coating, or 2) brackets configured to be part of the foam panel. The press also includes an upper press tool movable with respect to the lower press tool. The nozzle is configured to deposit liquid resin on the first liner within the volume, the liquid resin containing a foaming agent that causes the liquid resin to expand within the volume such that the resin bonds to the top surface of the first liner. The upper press tool presses a second liner against the frame while the liquid resin expands and solidifies into a foam between the first liner and the second liner and bonds to the first line and the second liner.

In some implementations, the manufacturing assembly further includes a robotic arm that including an end of arm tool that includes a rectangular frame, and vacuum cups attached to the rectangular frame. The vacuum cups grip the first liner and release the first liner on the top surface of the lower press tool.

Implementations of the present disclosure may provide improvements in the manufacturing and installation process of refrigerated enclosures by simplifying the steps of making and using foam panels. For example, implementations of the present disclosure may provide improvements in the quality of foam panels. For example, implementations of the present disclosure can reduce discontinuities and reductions in the insulating material. Additionally, robustness of design (e.g., fewer component parts, simple but effective geometries for component parts and resultant sub-assemblies) drives more consistent and repeatable sub-assemblies. Consequently, higher first pass-yields may be experienced on sub-assemblies with lowered costs of re-work and scrap, and faster quality inspections. The configuration of the foam panels can help improve the seal quality, durability, and insulating properties of joints between foam panels. For example, because two foam panels attached together are designed to interface with each other and have uniform dimensions, the seal at a joint (e.g., a half-lap joint) between the two panels can be more uniform and consistent, reducing air infiltration into the case during operation. Furthermore, the manufacturing process described here and can help reduce time and resources that are typically required to manufacture foam panels using existing methods. Using a non-stick frame eliminates the need of using foam boards utilized in existing methods. Additionally, the design of the foam panels and the equipment described here can enable making foam boards of different shapes and sizes. Furthermore, the disclosed methods may allow a quicker conversion between products of differing dimensions (e.g., panel length, width, and height) and/or different interface geometries (e.g., half-lap, tongue-and-groove, etc.) in fulfilling a wider range of customer needs. Lastly, the use of End-Of-Arm-Tools, conveyors, and other automated techniques avoids handling damage to sub-assembly foam panels prior to processing into a display case chassis and avoids handling damage to thin-sheet panel liners prior their assembly into a foamed panel.

BRIEF DESCRIPTION OF THE DRAWINGS

FIG. 11 is a side view of a bottom liner of the shell of the tank insulated foam panel in FIG. 8.

FIG. 12 is a side view of a top liner of the shell of the tank insulated foam panel in FIG. 8.

FIG. 13 is a side view of a bracket of the shell of the insulated foam panel in FIG. 8.

DETAILED DESCRIPTION OF THE DISCLOSURE

The present disclosure describes insulated foam panels that improve the process of assembling and installing refrigerated enclosures. The present disclosure also describes methods and equipment for manufacturing the insulated foam panels. The foam panels are simple in design, include fewer parts than conventional foam panels, and have interfacing edges that allows refrigerated enclosures to be quickly assembled, while maintaining thermally insulative joints. The process of manufacturing such panels can employ an assembly line that includes a press. The press includes a lower panel tool and an upper panel tool that together press a pair of sheets or liners to sandwich, with the sheets, an expanding foam until the foam hardens to form the foam panel. To make flat foam panels, the press can use a non-stick movable frame to form a foam panel in which the foam layer is exposed. To make non-flat panels, such as tank foam panels, the press can use permanent plastic brackets to form all or part of the periphery of the foam layer.

The foam panels can be used for various products or building materials that require insulation, e.g., a refrigerated display case chassis, doors, wall panels, etc. For example, a refrigerated display case chassis is an assembly that includes a tank (e.g., a base where a commercial refrigerator display case sits), a canopy that extends above the refrigerator display, and a back panel or wall that connects the tank to the canopy. Each of these components can be made of one or more insulated foam panels.

Figure 1:
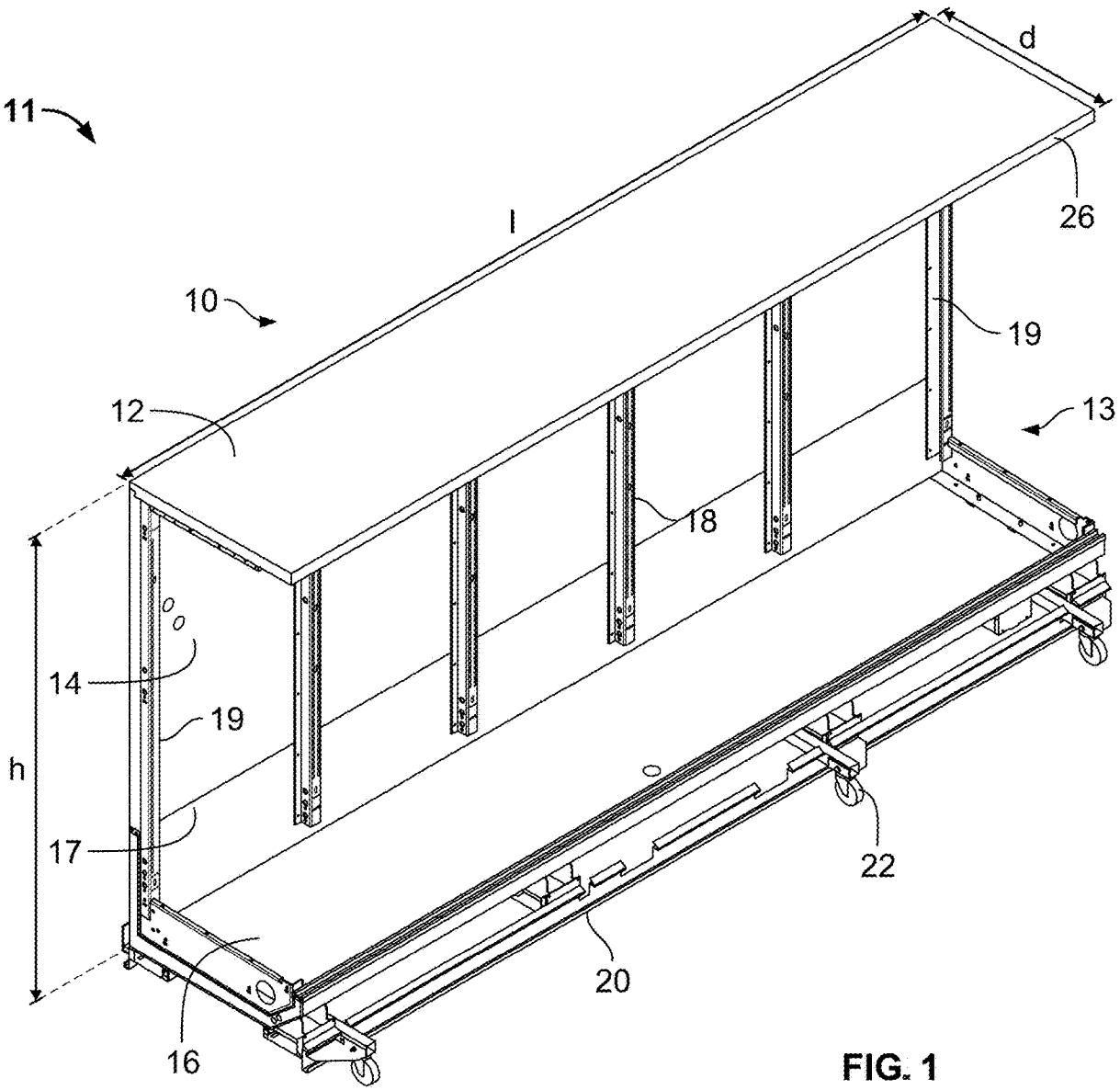
FIG. 1 is a perspective view of a refrigerated display case chassis according to implementations of the present disclosure.

FIG. 1 depicts a refrigerated display case chassis 10. For example, the refrigerated display case chassis 10 can be part of any type of refrigerated display case 11 such as a refrigerator, a freezer, or other enclosure (or partial enclosure) defining a temperature-controlled space. Specifically, the refrigerated display case chassis 10 can form the base, back wall, and roof of the refrigerated display case. The refrigerated display case can have side walls (not shown) made of insulated foam panels or a different material. If configured as an open-front display case, the refrigerated display case may have a front sill structure (not shown) comprised of aesthetic panels and/or protective bumpers which deflect shopping carts, with unimpeded or open access above the front sill to the temperature-controlled space. If configured as a door-case (e.g., a closed case), the front area of the refrigerated display case may include one or more doors (not shown) for accessing the refrigerated or frozen objects within the temperature-controlled space.

The refrigerated display case chassis 10 has multiple insulated panels (e.g., foam panels) 12, 14, 16 that form the base, back wall, and top of the refrigerated display case. Specifically, the refrigerated display case chassis 10 has a base or tank panel 16, a top or canopy panel 12, and a back panel 14 connecting the tank and canopy panels 16, 12. The tank panel 16 can form the floor of the refrigerated display case, the back panel 14 can form the back wall of the refrigerated display case, and the top panel 12 can form the roof of the refrigerated display case.

The refrigerated display case chassis 10 has a length 'l', a depth 'd', and a height 'h' that are based on the design specifications of the refrigerated display case. For example, the refrigerated display case chassis 10 can have a length 'l', depth 'd', and height 'h' based on a desired storage volume of the refrigerated display case. Additionally, the refrigerated display case chassis 10 can have a length 'l' that accommodates one, two, or more refrigerated display case doors.

The length 'l' of the refrigerated display case chassis 10 can be the same or substantially the same as the length of the top panel 12, the back panel 14, and the tank panel 16. Similarly, the depth 'd' of the refrigerated display case chassis 10 can be the same or substantially the same as the width of the top panel 12 and the tank panel 16. Moreover, the height 'h' of the refrigerated display case chassis 10 can be the same or substantially the same as the height of the back panel 14 together with a height of a vertical portion 17 of the tank panel 16.

The refrigerated display case chassis 10 also includes a base frame 20 and an upper frame 13 that includes middle brackets 18, and side brackets 19. The base frame 20 and the upper frame 13 can be made of metal, hard plastic, or a similar structural material. The tank panel 16 rests on the base frame 20. The base frame 20 can have wheels 22 for moving the refrigerated display case chassis 10. The side brackets 19 are attached to opposite sides of the chassis 10 and connect and support the three panels 12, 14, 16. The side brackets 19 can be C-shaped bracket and the middle brackets 18 can be L-shaped brackets.

Figure 2:
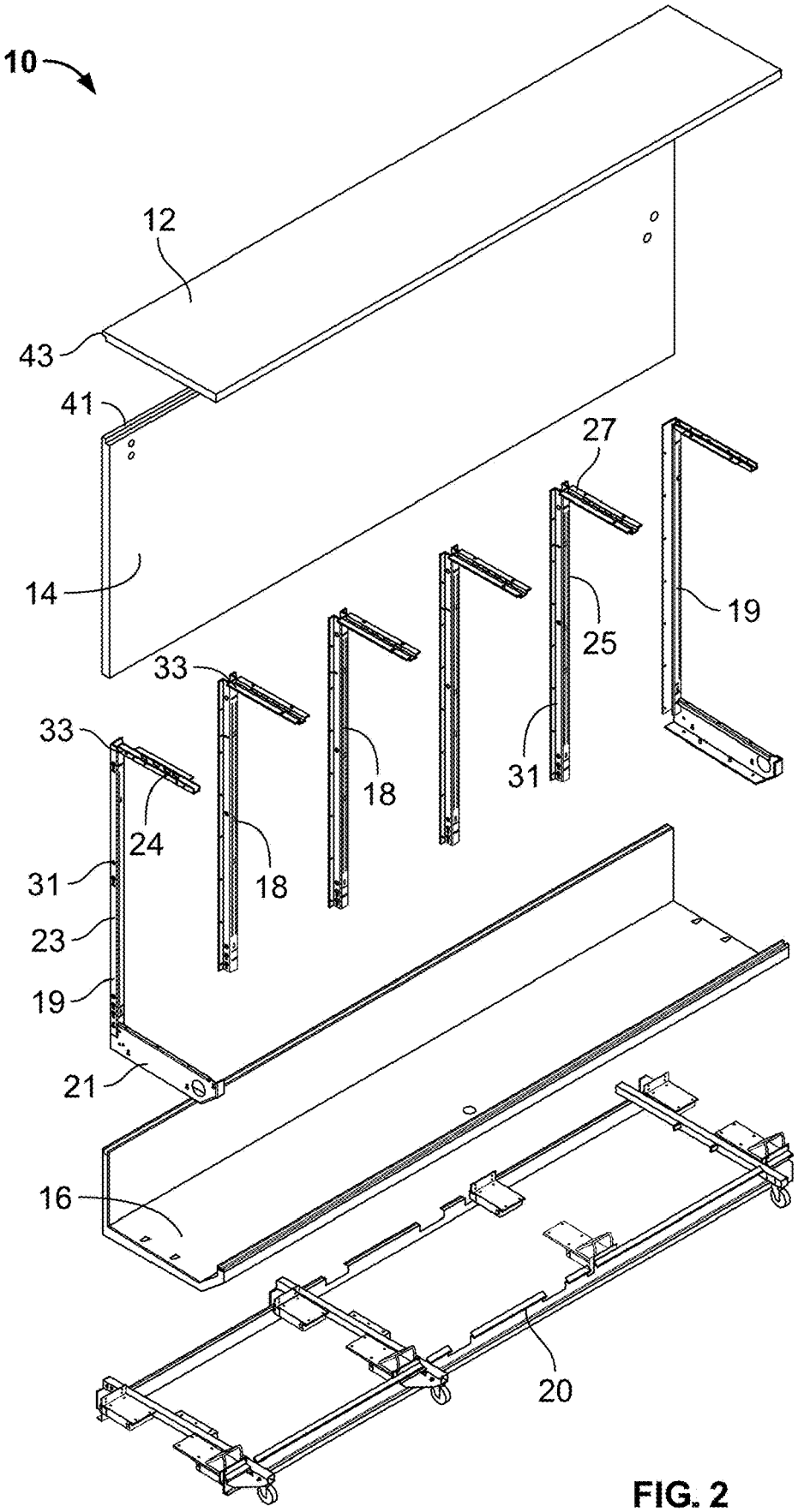
FIG. 2 is a perspective, exploded view of a refrigerated display case chassis in FIG. 1.

FIG. 2 shows an exploded view of the refrigerated display case chassis 10. The framing of the refrigerated display case chassis 10 has two side brackets 19 and one, multiple, or, in implementations in which the width of the case is small enough, no middle brackets 18. The side brackets have a base arm 21, a vertical arm 23 extending upright from an end of the base arm 21, and a top arm 24 extending from an upper end of the vertical arm 21. The base arm 21 has a bottom edge that corresponds with the cross-section of the tank panel 16.

The brackets 18, 19 have a vertical back surface 31 and a horizontal top support surface 33. The horizontal support surface 33 supports the top insulated panel 12 with the bracket attached to the back insulated panel 14, Both the back panel 14 and top panel 12 have a respective interface edge 41, 43 that includes a non-flat end such as a notched end to form a half-lap joint. The interface edges 41 of the back panel 14 interfaces and corresponds with the interface edge 43 of the top panel 12. Top and back panels 12, 14 can be attached at their interfaces by an adhesive such as an epoxy or a silicone sealant.

Figure 3:
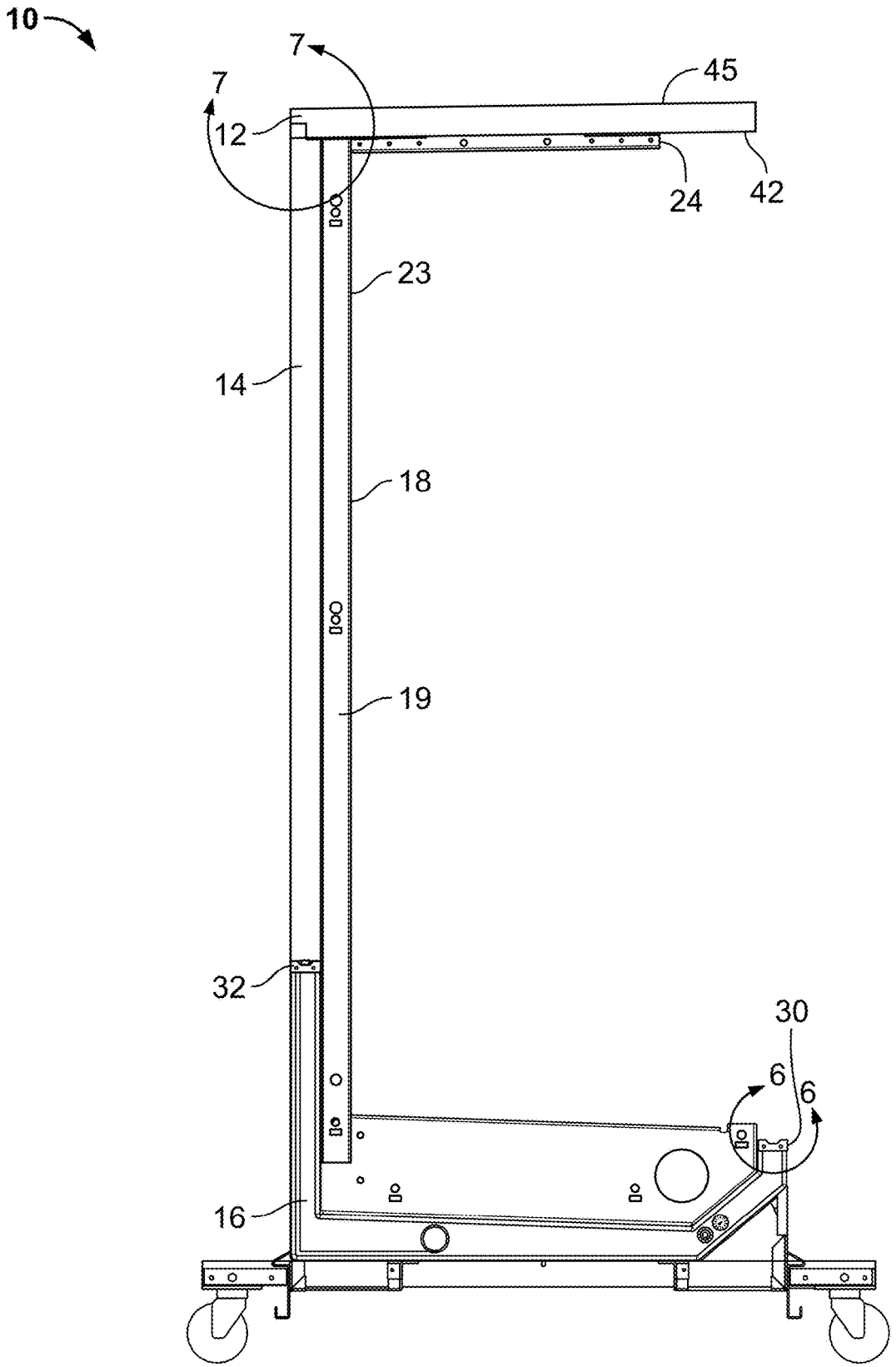
FIG. 3 is a side view of the refrigerated display case chassis in FIG. 1.

FIG. 3 illustrates a side view of the refrigerated display case chassis 10 assembled. The vertical and top arms 23, 24 of the brackets 18, 19 can form a 90 degree angle, a smaller angle, or, as shown, an angle larger than 90 degrees such as 90.75 degrees. Similarly, the vertical and bottom arms 23, 21 of the brackets 18, 19 can form a 90 degree angle, a smaller angle, or, as shown, an angle larger than 90 degrees such as 92 degrees.

The tank panel 16 is attached to the back panel 14 to form a second joint 32. The second joint 32 can be formed with a tape or sealant disposed between the two panels and with mechanical fasteners.

Figure 4:
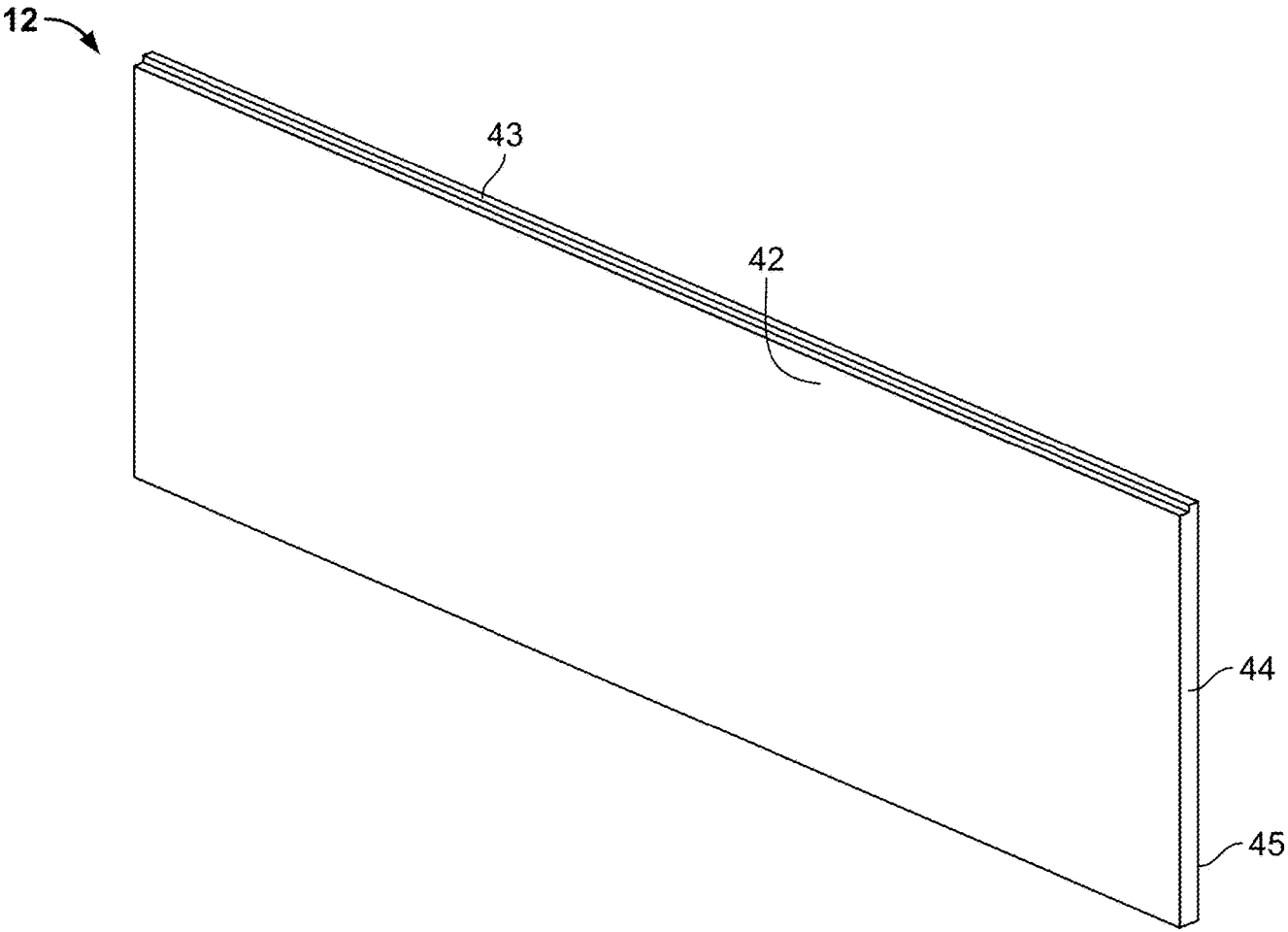
FIG. 4 is a perspective view of an insulated foam panel according to implementations of the present disclosure.
Figure 5:
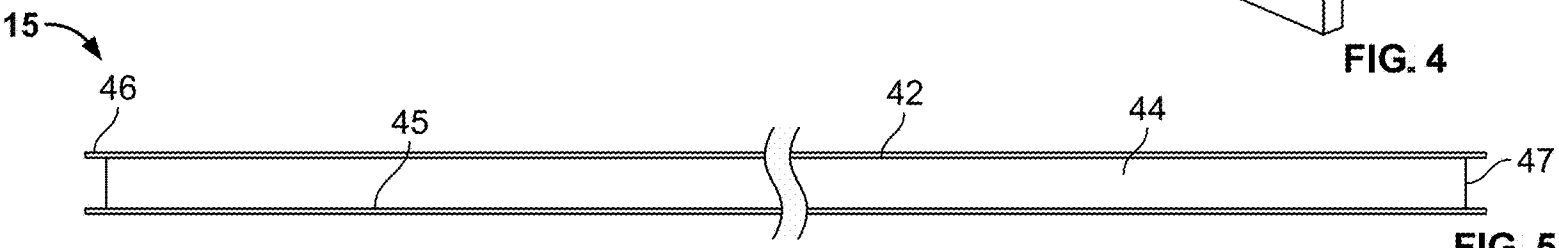
FIG. 5 is an end view of an untrimmed flat foam panel according to implementations of the present disclosure.

Referring also to FIGS. 4 and 5, the top panel 12 has a foam layer 44 bounded by (e.g., sandwiched between) a lower sheet or liner 42 (e.g., a thermally conductive sheet) and an upper sheet or liner 45 (e.g., a thermally conductive sheet). The sheets 42, 45 can be made of metal such as aluminum or stainless steel and can have a greater thermal conductivity than the foam layer 44. In some implementations, the sheets 42, 45 could also be made of other non-metallic materials (e.g., FR-4 fiberglass) that have a greater thermal conductivity than the foam layer 44. The matting interface 43 is formed in the foam layer 44 of the panel 12. For example, the notched edge is a foam edge that is directly attached to the foam edge of the back panel 14. The notched edge can be formed during the curing process of the foam or can be cut after the foam cures (e.g., during trimming of the panel). The back panel 14 is similar to the top panel 12 and can be made with the same materials.

As shown in FIG. 5 and as further described in detail below with respect to FIGS. 14-19, a flat insulated panel 15 (e.g., the back panel or the top panel) can be formed in a press such that edges 46 of the sheets 42, 45 extend beyond the edge or periphery 47 of the foam layer 44. After being formed in the press, the edges 46 can be trimmed so that the edges 46 are flush with the edge 47 of the foam layer 44. Specifically, the flat foam panels can be trimmed along the edge of the hardened foam layer to provide, when assembled together, a precise fit between the foam panels. During trimming, a longitudinal notch can be cut on the edge or periphery of the foam layer to make, with the other panel, a half-lap joint. Cutting the longitudinal notch may include further cutting a portion of one of the sheets to be flush with the edge of the notched foam.

Figure 6:
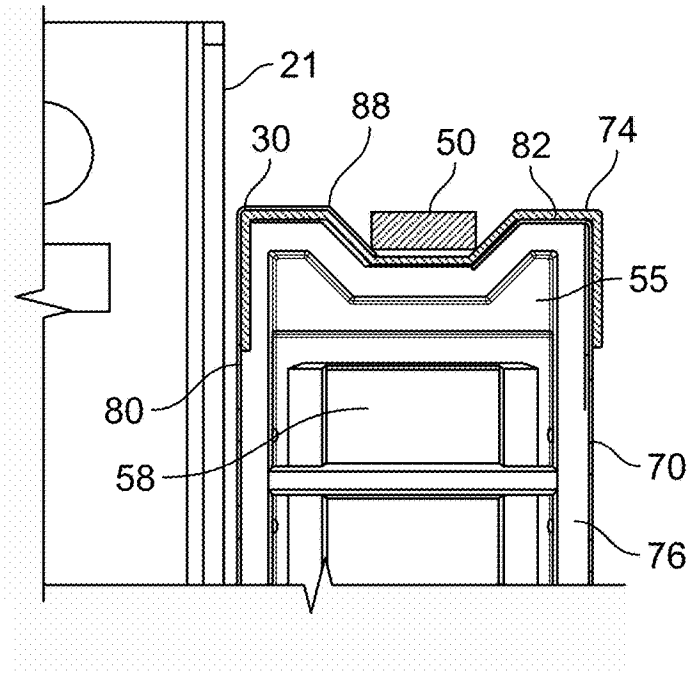
FIG. 6 is a detail view taken along line 6-6 in FIG. 3.

FIG. 6 shows a detail, cross-sectional view taken along line 6-6 in FIG. 3, showing a front, upper edge 30 of the tank panel 16. The upper edge 30 is disposed adjacent the lower arm 21 of the C-shaped bracket 19. As further described in detail below with respect to FIGS. 11-13, the tank 16 has a cap bracket 74 (e.g., an M-shaped longitudinal breaker) that overlaps a tab 82 of the lower sheet 70 of the tank 16 and is disposed under a tab 88 of the upper sheet 80. The bracket 74 can include a tape 50 or sealant that attached to a component of the refrigerated display case such as a frame of a door.

The tank foam panel 16 also has end caps 76 (e.g., end breakers or side caps) on each end of the panel 16. The end or side caps 76 form an edge of the tank panel 16 and include a reinforcement core 58 (e.g., a honeycomb core, a truss core, or a similar core) that adds structural reinforcement to the tank panel 16. The end caps 76 can include engineered gaskets 55 and/or tape disposed along the edge of the caps 76 between the caps 76 and the cap bracket 74 (and tank sheets) to form a fluid seal between the caps and 76 and the cap brackets 74 to prevent foam from leaking through the interfaces formed between the parts of the tank shell.

Figure 7A:
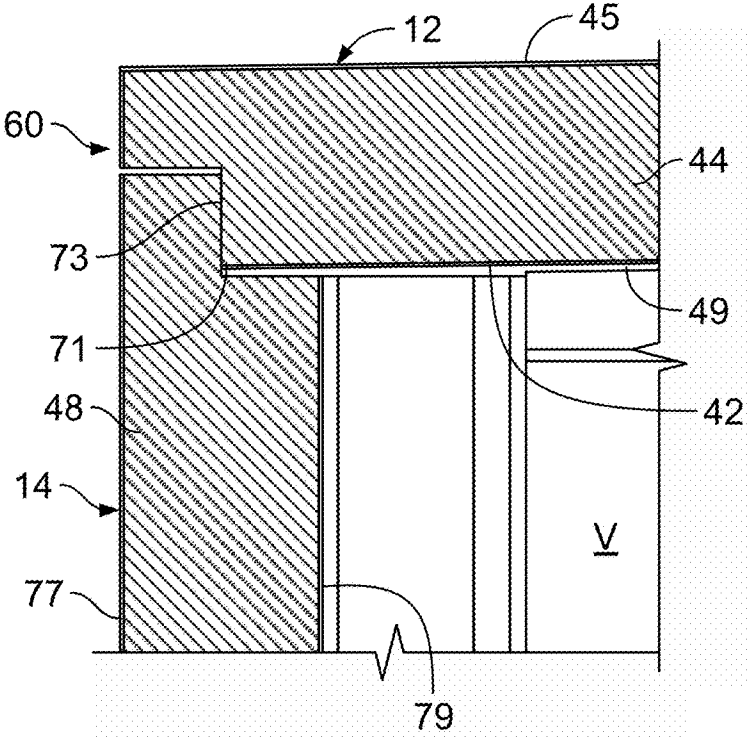
FIG. 7A is a detail view taken along line 7-7 in FIG. 3.

FIG. 7A shows a detail, cross-sectional view taken along line 7-7 in FIG. 3. The top panel mates with the back panel 14 to form a thermally insulated joint 60 (e.g., a half-lap joint) where, in cross-section, one sheet of the pair of sheets of the one of the panels terminates at a surface (e.g., an interior surface) of a foam layer of the other one of the foam panels. For example, the lower sheet 42 has an edge 71 that ends at the interior surface 73 of the foam layer 48 of the back panel 14. The edge 71 can directly contact the interior surface 73 or there can be an adhesive layer disposed between the two. Additionally, the internal sheet 79 of the back panel 14 can terminate at a surface 49 (e.g., an interior surface) of the lower sheet 42 of the top panel 12. The interior surface 49 of the sheet 42 faces the interior volume 'v' of the refrigerated display case and spans the width of the top foam panel 12.

In some implementations, the joint 60 can be a different type of joint such as a rabbet joint, a tongue and groove joint, a butt joint, a box joint, or a similar joint. However, the simplicity and reliability of the half-lap joint allows an operator or a machine to quickly assemble the two panels, while maintaining thermal insulation at the joint 60. In other words, the joint 60 prevents any thermally conductive path ("short circuit") from the inside of the case to the outside of the case 10 by any of the thermally conductive sheets 42, 45, 77, 79. The joint 60 forms the upper corner of the refrigerated display case.

Figure 7B:
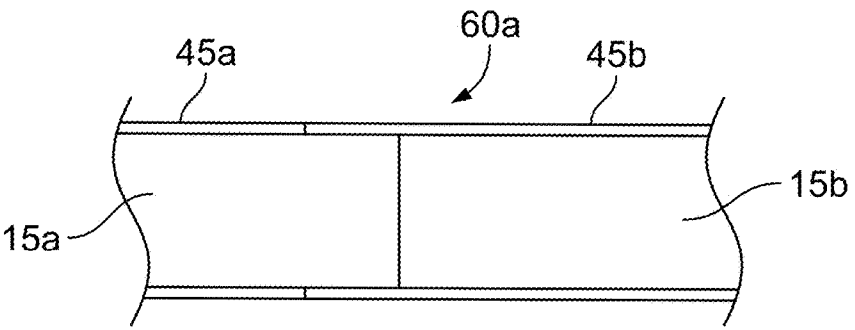
FIG. 7B is a detail view of a joint according to implementations of the present disclosure.

FIG. 7B shows a joint 60*a* of two panels 15*a*, 15*b* arranged along a common plane. For example, the two panels 15*a*, 15*b* can make the back wall of the refrigerated display. In the joint 60*a*, the first foam panel 15*a* has a first flat foam edge and the second foam panel 15*b* has a second flat foam edge that corresponds with the first flat foam edge. As shown, the first foam panel 15*a* can be inserted (e.g., as male and female connections) into the second foam panel 15*b*. For example, the first flat foam edge of the first panel 45*a* extends beyond a first edge or end of the first pair of liners 45*a* first distance. The second foam edge of the second panel 15*b* is offset from a second edge of the second pair or liners 45*b* a second distance equal to the first distance to form a female interface. When brought together, the panels 15*a*, 15*b* form a male-female connection with the first foam edge inserted into the second insulated panel and terminating at the second foam edge.

Figure 8:
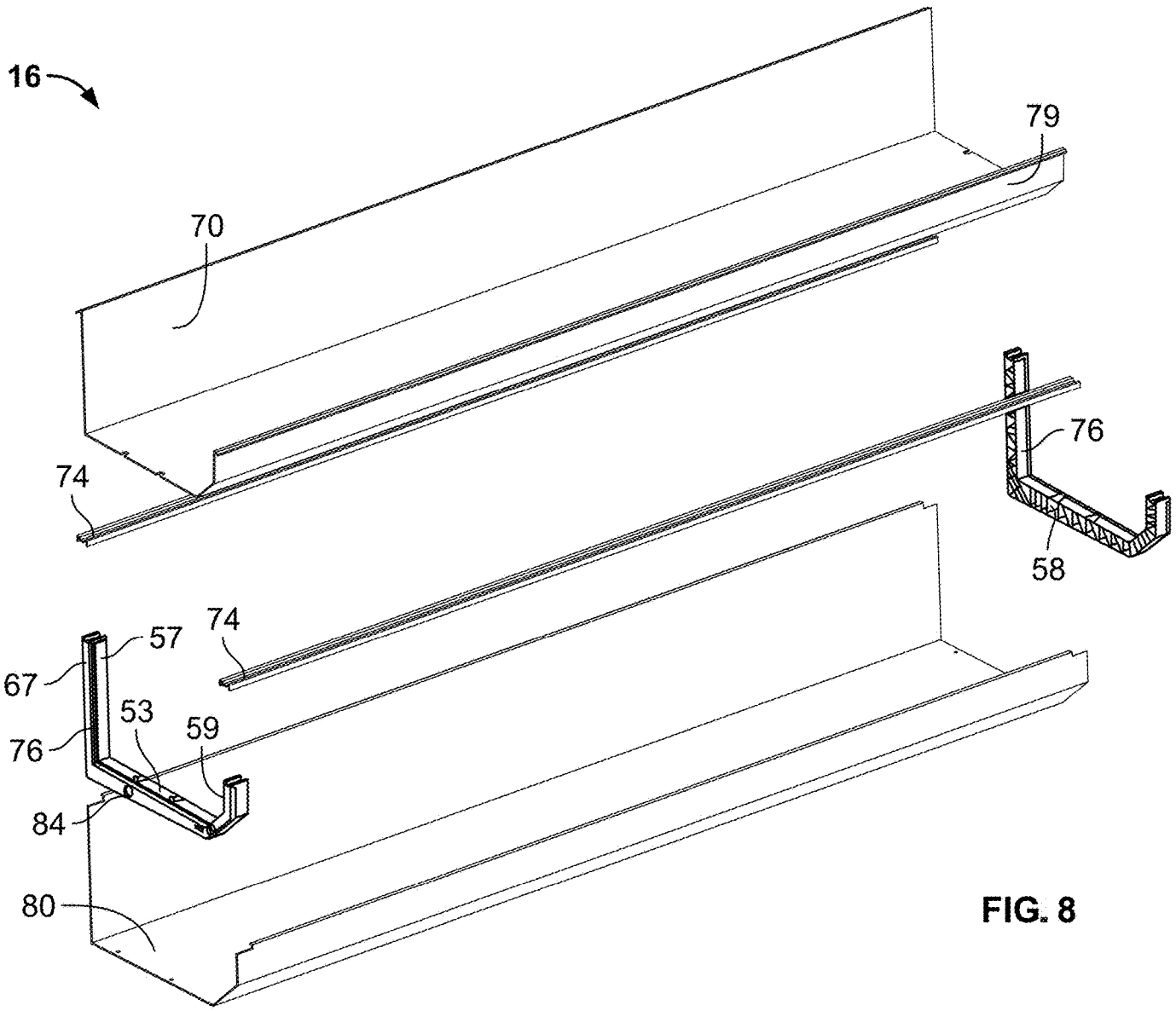
FIG. 8 is a perspective, exploded view of a shell of a tank insulated foam panel according to implementations of the present disclosure.

FIG. 8 illustrates an exploded view of a shell (e.g., the components surrounding the foam layer) of the tank panel 16. The foam layer (not shown) of the tank 16 is sandwiched between the top sheet 70 and the bottom sheet 80. The non-flat sheets 70, 80 can be formed with different methods such as by folding the sheets, extruding the sheets, soldering multiple sheets together, etc. However, each sheet 70, 80 is a one-piece sheet, which simplifies the manufacturing process of the tank panel 16.

Figure 10:
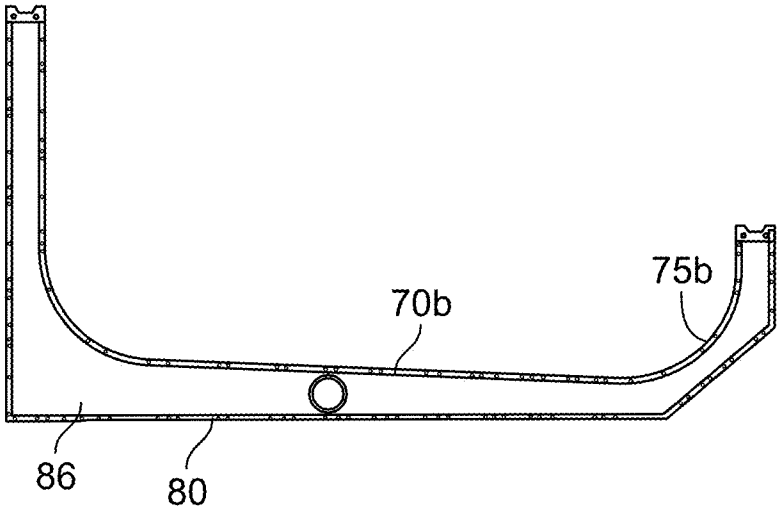
FIG. 10 is a side view of a tank insulated foam panel according to a second implementation of the present disclosure.
Figure 9:
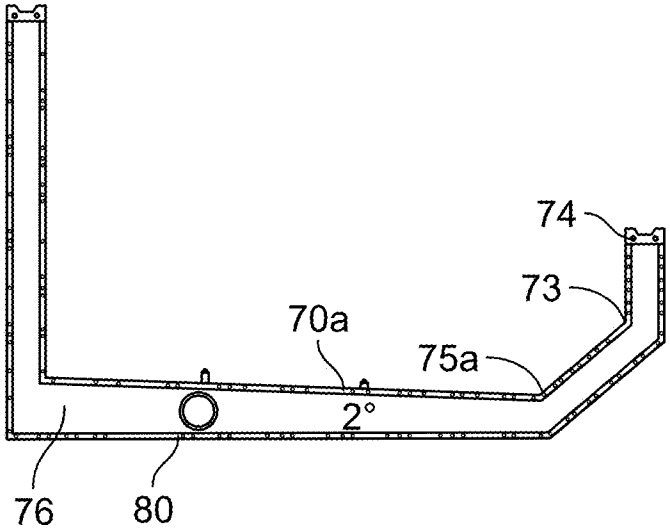
FIG. 9 is a side view of a tank insulated foam panel according to a first implementation of the present disclosure.

Referring also to FIGS. 9 and 10, depending on manufacturing methodologies and the desired specifications of the tank foam panel, the tank foam panel can have top sheets 70*a*, 70*b* of different configurations. For example, as shown in FIG. 9, the top sheet 70*a* can have sharp corners or bends 75*a*. Additionally, as shown in FIG. 10, the top sheet 70*b* can have round corners or bends 75*b*. The lower sheet 80 can similarly be square or round (not shown). The lower and upper sheets 70, 80 form, in side view, a tank panel 16 with a non-flat cross-section.

Referring to FIG. 8, one of the end caps 76 (e.g., the left end cap) can have a port 84 where liquid foam is injected during the manufacturing process. The end caps 76 can have an outer wall 67 surrounding the reinforcement core 58. During manufacturing, the reinforcement core 58 of the end caps 76 allows foam to enter the volume defined by the outer wall 67 to reinforce the end caps 76 and bond the end caps 76 to the foam layer.

As further described in detail below with respect to FIGS. 20-24, the sheets 70, 80, end caps 76, and cap brackets 74 (e.g., a rearward cap bracket and a forward cap bracket) are assembled together to form an outer shell that is sealed to prevent the expanding foam from leaking through the shell during the manufacturing process of the tank 16.

The end caps 76 define, in side view, a cross-section that corresponds with the non-flat cross-section of the sheets 70, 80. The caps 76 include two vertical surfaces 57, 59 and a horizontal surface 53 extending between and connecting the two vertical surfaces 57, 59. There can be an angled surface extending between the horizontal surface 53 and one of the vertical surfaces 59.

The end caps 76 together with the cap brackets 74 can form a frame or periphery that extending along all edges of the tank panel 16 and defines a volume, with the sheets 70, 80 that contains the foam layer. The frame and the sheets 70, 80 (e.g., the outer shell) are bonded to the foam layer during curing of the foam layer.

FIG. 11 illustrates a side view of the bottom or lower tank sheet 80. The bottom sheet 80 has a first vertical surface 81 and a second vertical surface 83 opposing the first vertical surface 81. The bottom sheet 80 has a first inwardly-projecting tab 88 that extends from the first vertical surface 81 (e.g., from an upper end of the sheet 80). The tab 88 extends along the length (e.g., the entire length) of the sheet 80. The tab 88 has, in side view, a hook shape. For example, the tab 88 has a horizontal portion 91 and an angled portion 93 extending from the horizontal portion 91. Referring also to FIG. 13, the tab 88 has a shape that corresponds with a first portion 'A' of a first cap bracket 74 (e.g., a rearward cap bracket). The portion 'A' of the cap bracket 74 has a horizontal and an angled portion similar to the horizontal and angled portion of the first inwardly-projecting tab 88.

FIG. 12 illustrates a side view of the top or upper tank sheet 70. The top sheet 70 has a first vertical surface 72 and a second vertical surface 78 facing away from the first vertical surface 72. The top sheet 70 has a first outwardly-projecting tab 86 that extends from the first vertical surface 72. Similar to the tab 88 of the bottom sheet 80, the outwardly-projection tab 86 extends along the length (e.g., the entire length) of the sheet 70 and has, in side view, a hook shape. Referring also to FIG. 13, the outwardly-projecting tab 86 has a shape that corresponds with a second portion 'B' of the first cap bracket 74 (the rearward cap bracket) opposite the first portion 'A'. The portion 'B' of the cap bracket 74 has a horizontal and an angled portion similar to the horizontal and angled portion of the outwardly-projecting tab 86.

As shown in FIG. 11, the tank 80 has a second inwardly-projecting tab 82 that extends from the second vertical surface 83. The second tab 82 is similar to the first tab 88. For example, the second tab 82 extends along the length of the sheet 80 and has, in side view, a hook shape. Referring also to FIG. 13, the second tab 82 has a shape that corresponds with a second portion 'B' of a second cap bracket 74 (e.g., a forward cap bracket) opposite the first portion 'A'. Similar to portion 'A', portion 'B' of the cap bracket 74 has a horizontal and an angled portion similar to the horizontal and angled portion of the first inwardly-projecting tab 88.

The cap bracket 74 has horizontal middle portion 92 that connects portion 'A' to portion 'B'. The width of the middle portion 92 can depend, for example, on a thickness of the tank foam board. The cap bracket 74 also has vertical portions 90 that, together, embrace the ends of the bottom and top tank sheets 70, 80 to help maintain the sheets or liners together.

Referring to FIGS. 11 and 12, the bottom tank sheet 80 has a second inwardly-projecting tab 82 that, when assembled, faces a second outwardly-projecting tab 89 of the top tank sheet 70, similar to the first tabs 88, 86 of the tank sheets.

Figure 14:
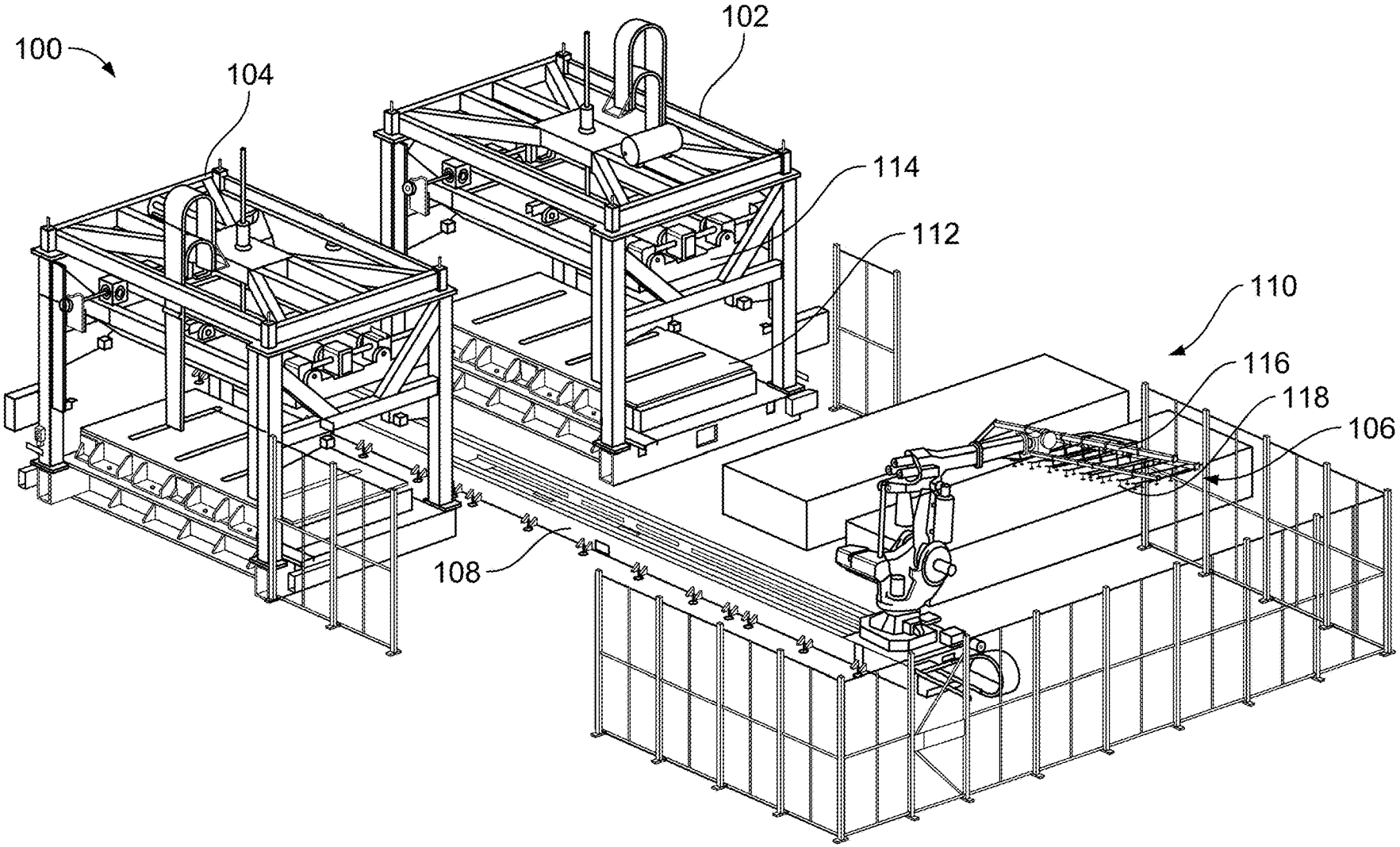
FIG. 14 is a perspective view of an assembly line for manufacturing insulated foam panels according to implementations of the present disclosure.

FIG. 14 illustrates a perspective view of an assembly line 100 for automatically manufacturing insulated foam panels. The assembly line 100 can include conveyors 110 (e.g., sheet and foam panel conveyors), one or more robotic arms 106, one or more presses 102, 104, a foam nozzle (not shown), and a tool storage assembly (not shown) that may include a tool storage rack and a tool elevator.

The presses 102 has a lower panel tool 112 and an upper panel tool 114. In some implementations, the lower and upper panel tools 112, 114 used to make the back foam panel can be the same tools used to make the top foam panel. Additionally, the lower and upper panel tools 112, 114 used to make the tank foam panel can be different than the panel tools 112, 114 used to make the top and back foam panels.

The robotic arm 106 can be mounted on a linear track rail 108. The robotic arm 106 can move along the linear track rail 108 to grab sheets from a conveyor 110 and position the sheets in the presses 102, 104. After the foam board is formed in one of the presses 102, 104, the arm 106 can move the foam boards to a conveyor 110 that takes the foam boards to another station (e.g., a trimming station). For example, components of the assembly line 100 can prepare the foam panels for assembly (e.g., by way of a half-lap joint) by cutting the foam panels to size and applying silicone sealant.

The robotic arm 106 can have an end of arm tool 116 (EAOT) that has multiple suction cups 118 (e.g., vacuum cups). The EAOT 116 can be moved toward a sheet laying on the conveyor 110. Once the EAOT 116 is on top of the sheet, the suction cups 118 can engage the sheet to lift and move the sheet away from the conveyor 110. The robotic arm 106 first places the lower sheet on a top surface of the lower panel tool 112 of the press 102. The robotic arm 106 then places the upper sheet on top of a frame (e.g., a non-stick frame) of the lower panel tool 112 that is disposed on top of the lower sheet. With the lower and upper sheets in place, the press 102 lowers the upper panel tool 114 to press the sheets as the foam is injected and as the foam expands between the two sheets.

There are multiple embodiments of the EAOT 116. For example, as shown in FIG. 14, the EAOT 116 used to move flat sheets (e.g., sheets for the back foam panel and the top foam panel) can include a flat frame with vacuum cups residing along a common horizontal plane. The EAOT 116 can also hold different sizes of panels by selectively turning on or off groups of suction cups. An EAOT used to move sheets for the tank foam panel can have a similar flat frame but also include an adjustable clamp with suction cups that can hold opposite surfaces of a sheet with a U-shape cross-section. This clamp can be extendable and retractable to grip top and bottom sheets of different shapes and sizes.

Figure 15:
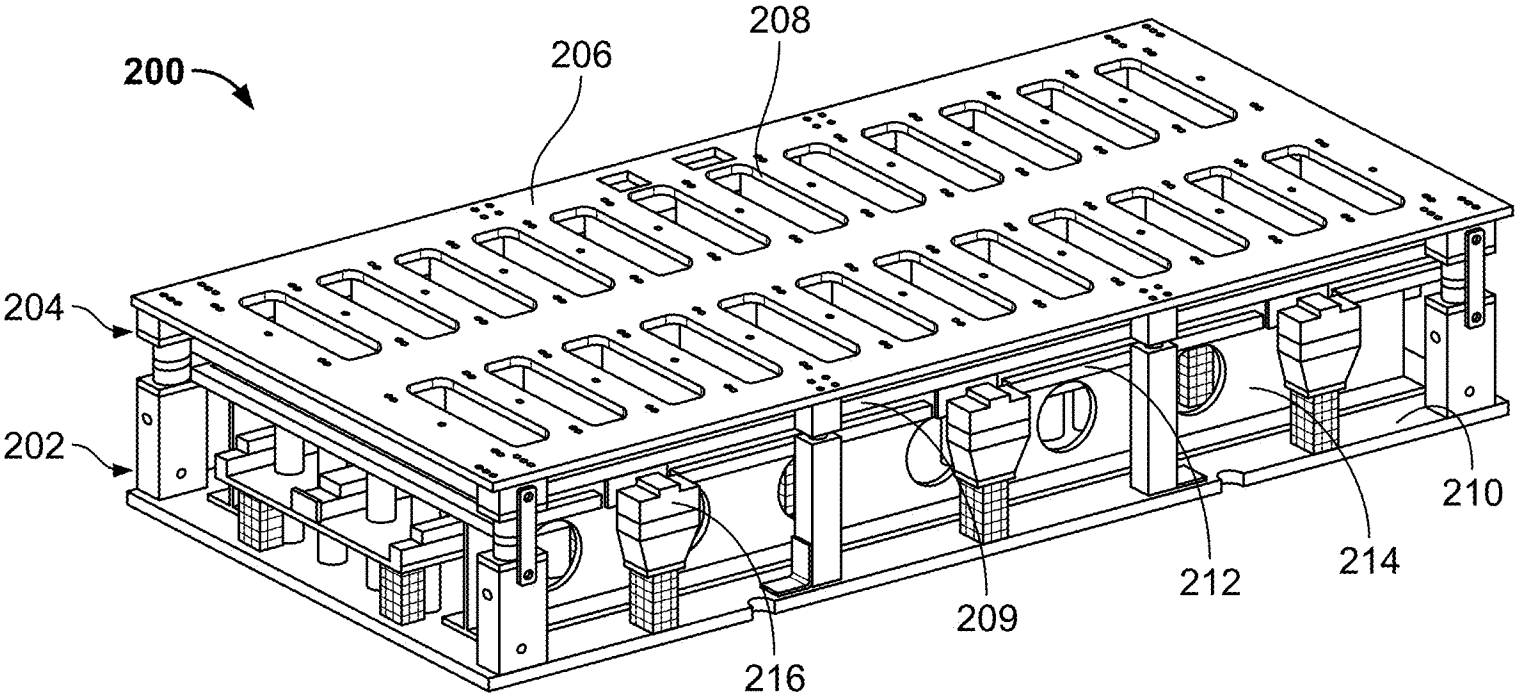
FIG. 15 is a perspective view of a lower panel tool and an upper panel tool of a press of the assembly line in FIG. 14, for making float foam panels.

FIG. 15 illustrates a perspective view of a press tool assembly 200. The press tool assembly 200 includes a lower panel tool 202 and an upper panel tool 204 similar to the lower and upper panel tools 112, 114 in FIG. 14. The lower panel tool 202 and upper panel tool 204 are used to make flat foam panels (e.g., back and top foam panels).

The upper panel tool 204 has a top frame 206 with engagement features 208 (e.g., slots or fork-lift tubes). The press can engage the engagement features 208 to secure the upper panel tool 204 to the press. The upper panel tool 204 has a plate 209 that faces the lower panel tool 202. The plate 209 directly contacts the top sheet during the manufacturing of the foam panels.

The lower panel tool 202 has a base 210 that is engaged by the press to secure the lower panel tool 202 to the press. The lower panel tool 202 also includes a top plate 212 and a middle frame 214 that resides between the base 210 and the top plate 212. The top plate 212 faces the plate 209 of the upper panel tool 204. The top plate 212 directly contacts the bottom sheet during the manufacturing of the foam panels. As further described in detail below with respect to FIGS. 17 and 18, the lower panel tool 202 can also have actuators 216 (e.g., pneumatic guided cylinders) to move bars or rails of the lower panel tool 202 that form the non-stick frame.

Figure 16:
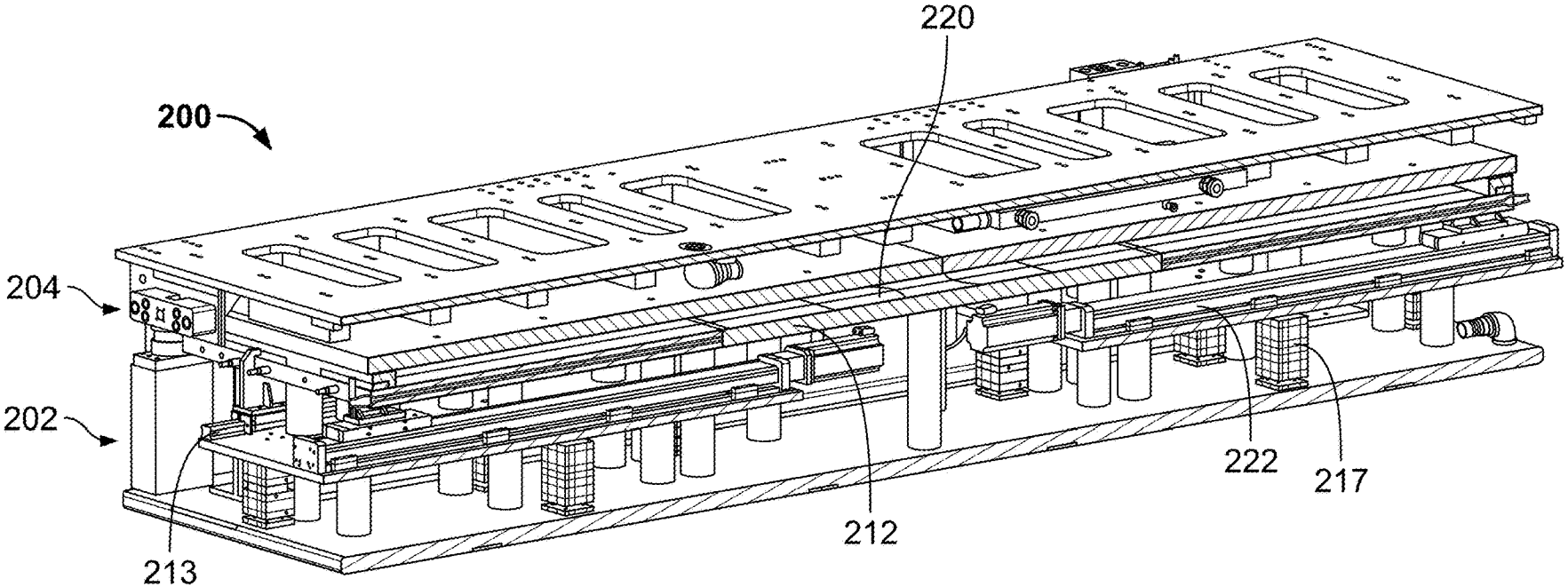
FIG. 16 is a perspective, cross-sectional view of the lower panel tool and an upper panel tool in FIG. 15.

FIG. 16 depicts a cross-sectional view of the press tool assembly 200. The lower panel tool 202 has internal actuators 217 (e.g., stacked guided cylinders) that move the bars of the non-stick frame. The lower panel tool 202 also includes linear actuators 223 (e.g., dual ball screw linear actuators) that move side bars of the non-stick frame. The lower panel tool 202 also includes linear guides and rails 213 to help move the side bars. The top plate 212 of the lower panel tool 204 has a top surface 220 that supports the bottom sheet of the foam panel. The bars and side bars of the non-stick frame move along the top surface 220 of the lower panel tool 204.

Figure 17:
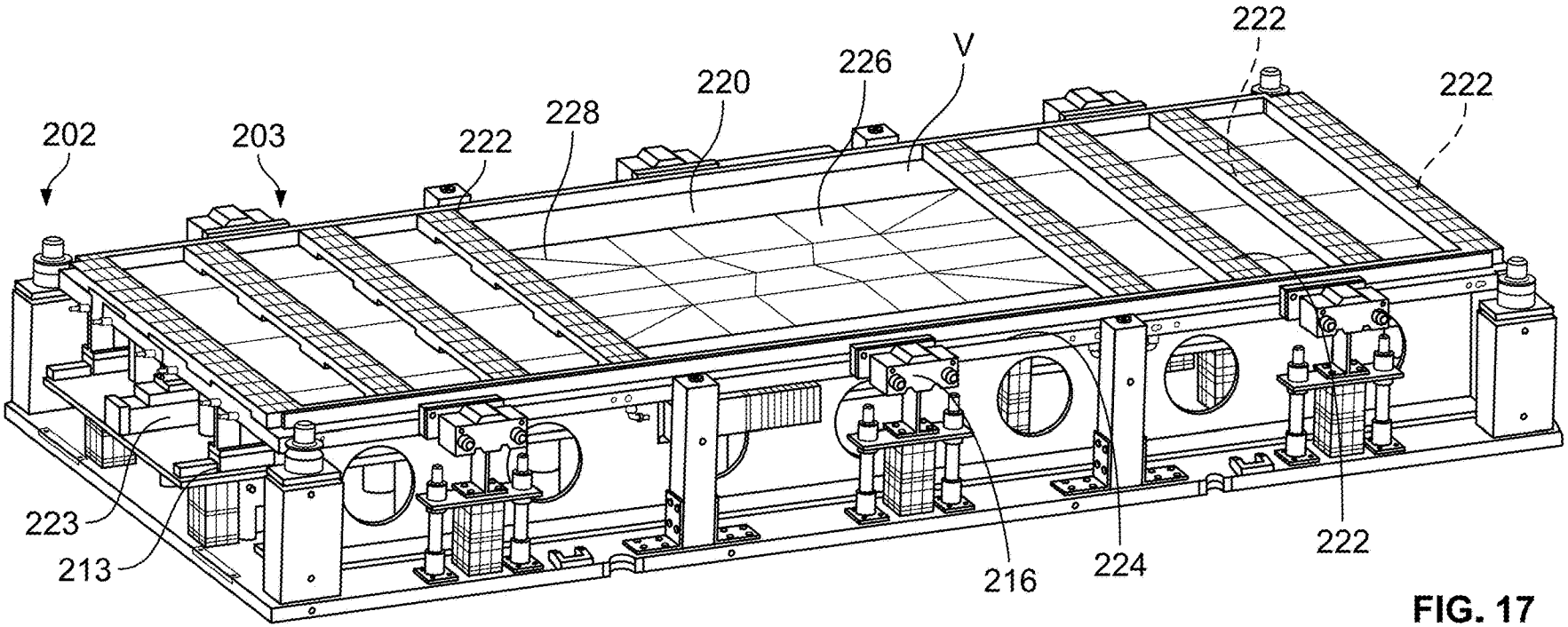
FIG. 17 is a perspective view of the lower panel tool in FIG. 15.
Figure 18:
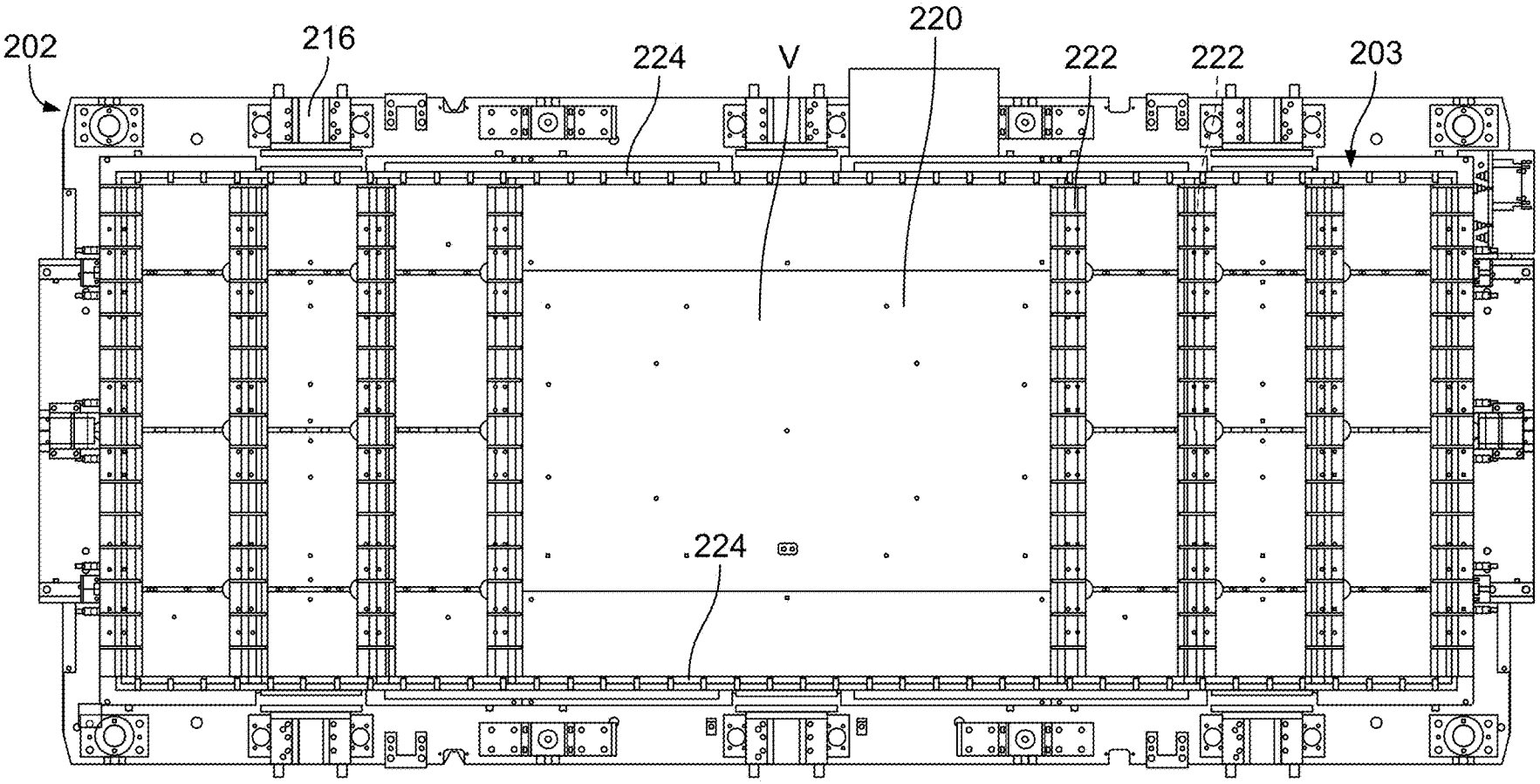
FIG. 18 is a top view of the lower panel tool in FIG. 17.

FIG. 17 illustrates a perspective view of the lower panel tool 202 and FIG. 18 shows a top view of the lower panel tool 202. Referring to FIGS. 17 and 18, the lower panel tool 202 has a configurable non-stick frame 203 that includes two longitudinal bars or rails 224 spaced from each other and two side bars 222 perpendicular with respect to and disposed between the longitudinal bars 224. The configurable non-stick frame 203 allows the panel tool 202 to form flat foam panels of different lengths. For example, the two lateral, parallel bars 224 move along the length of the longitudinal, parallel bars 224 to form a rectangular volume 'V' (e.g., similar to a picture frame) defined between the four bars 222, 224. The four bars 222, 224 together form the rectangular volume 'V' bordered by the bars 222, 224 where the foam is to be deposited. FIGS. 17 and 18 show the lateral bars 222 in multiple positions along the top surface of the tool 202 to illustrate the different configurations of the non-stick frame 203.

The longitudinal bars 224 can be moved by the side actuators 216 to press the bars 224 against the ends of the lateral bars 222 to prevent foam from leaking through the interface between the two bars 222, 224. The linear actuators 223 below the surface 220 of the tool 202 move the two side bars 222 to a desired location based on a length of the foam board to be made. The bars 222, 224 can separate from each other (and in some cases from the top surface 220) to allow the sheet to be placed on the top surface 220 of the bottom panel tool 202. After the sheet is places on the top surface 220, the bars 222, 224 are moved to close the frame on top of the sheet.

The non-stick frame 203 on top of the sheet can create a pinch seal with the sheet metal to contain the foam. With the frame 203 closed, the foam nozzle deposits liquid foam on the bottom panel within the volume 'V'. Each bar 222, 224 of the frame 203 can have a non-stick coating that allows the rails to be quickly removed from the hardened foam once the foam panel is ready to be removed from the press. In some implementations, the bars 222, 224 can have a cross-section that forms a half-lap joint cross section in the foam layer of the foam panel.

As shown in FIG. 17, the top surface 220 of the lower panel tool 202 can have a vacuum surface 226 with vacuum channels 228 or holes to firmly grip the sheets and prevent the sheets from moving during the foaming process.

Figure 19:
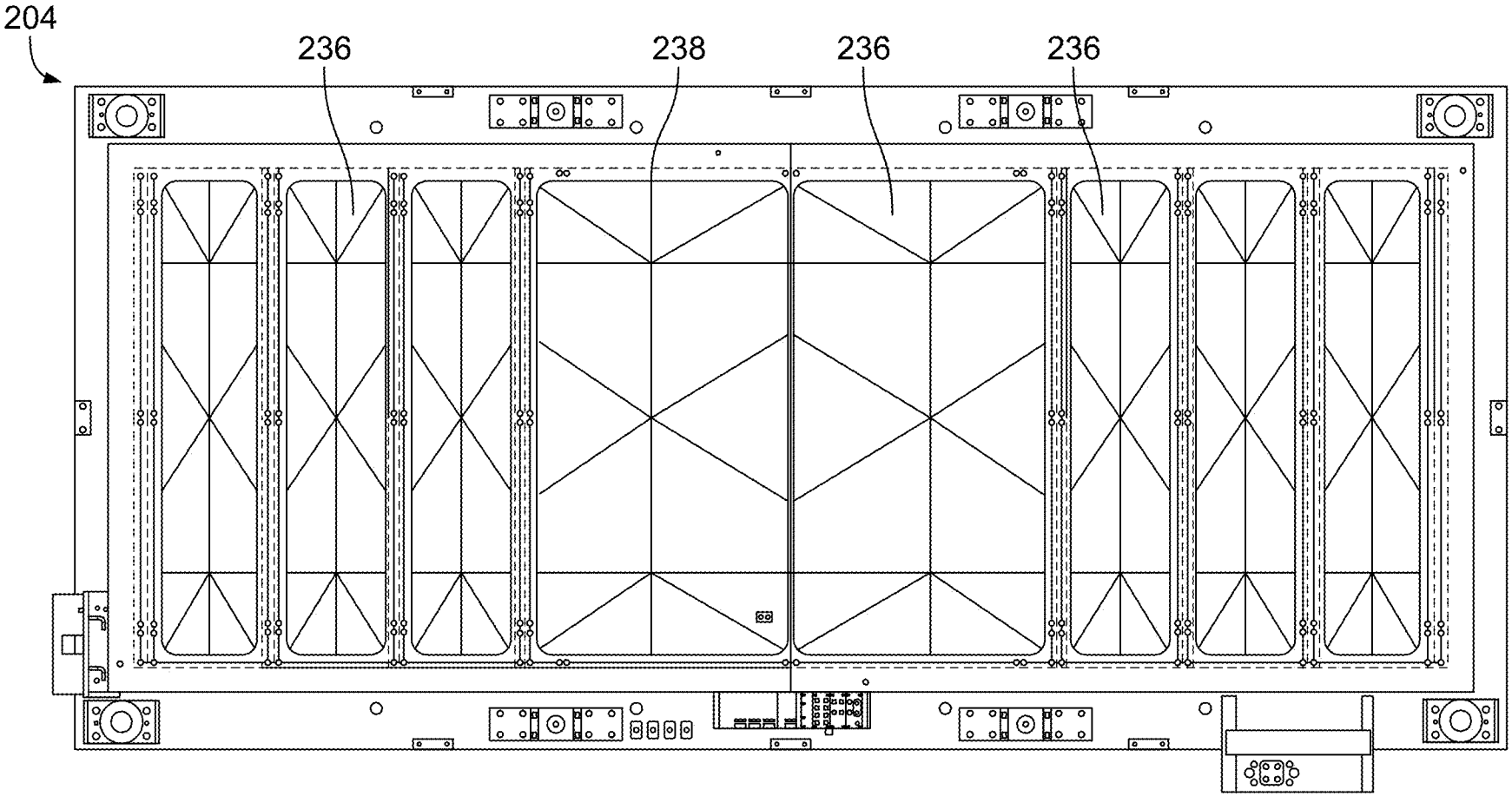
FIG. 19 is a top view of the upper panel tool in FIG. 15.

FIG. 19 depicts a top view of the upper panel tool 204. The upper panel tool 204 can also have a vacuum surface 236 with vacuum channels 238 or holes that firmly suck and grip the sheets (e.g., the upper sheet) and prevents the sheets from moving during the foaming process. The upper panel tool 204 can have multiple vacuum surfaces 236 that can be selectably turned on and off depending on the size of the sheet.

During the manufacturing process, the foam nozzle deposits liquid resin or foam on the bottom sheet within the volume 'V' defined by the non-stick frame 203. The EAOT places a top sheet on the frame 203, overlaying the bottom sheet. The press lowers the upper panel tool 204 to press the top sheet against the frame 203, thereby sandwiching the foam between the two sheets as the foam expands and hardens. With the foam hardened, the EAOT removes the foam panel from the press.

Figure 20:
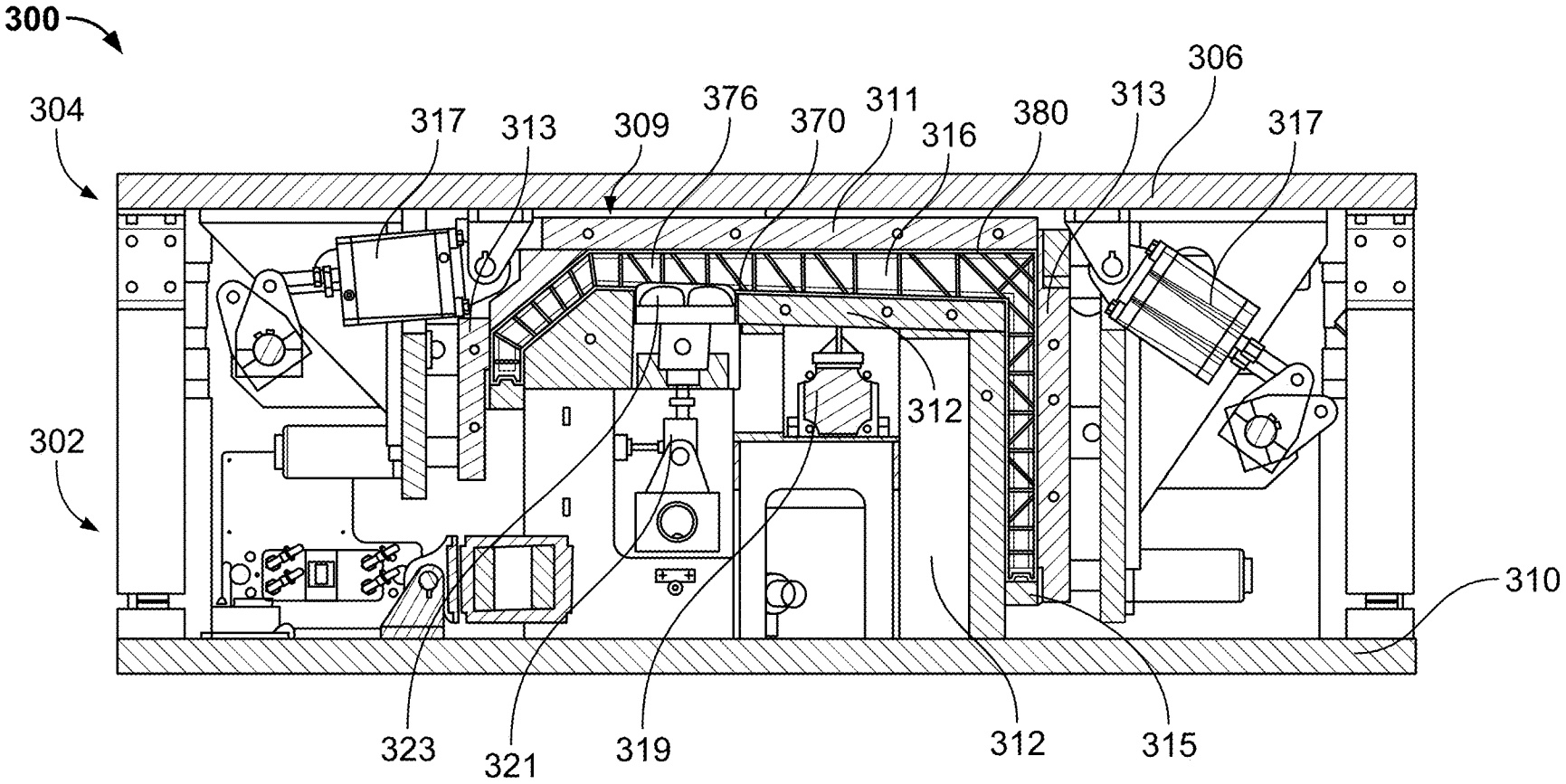
FIG. 20 is a side view of a lower panel tool and an upper panel tool of a press of the assembly line in FIG. 14, for making tank foam panels.

FIG. 20 illustrates a side view of a press tool assembly 300 according to a different implementation of the present disclosure. The press tool assembly 300 includes a lower panel tool 302 and an upper panel tool 304. Similar to the lower and upper panel tools 112, 114 in FIG. 14, the lower and upper panel tools 302, 304 are attached to respective lower and upper parts of a press. The lower panel tool 302 and upper panel tool 304 are used to make non-flat foam panels 316 (e.g., tank foam panels).

The upper panel tool 304 has a top frame 306 that is engaged by the press to secure the upper panel tool 304 to the press. The upper panel tool 304 has a plate 309 that has, in side view, a U-shape cross section. For example, the plate 309 includes a horizontal base 311 and two vertical walls 313 that can be moved by actuators 317 (e.g., linear actuators) to form a cross-section of the tank foam panel 316 and press the side walls 313 toward the foam panel. The plate 309 directly contacts the bottom tank sheet 380 of the tank foam panel during the manufacturing of the tank foam panels.

The lower panel tool 302 has a base 310 that is engaged by the press to secure the lower panel tool 302 to the press. The lower panel tool 302 also includes a top plate 312 and a middle frame 314 that resides between the base 310 and the top plate 312. The top plate 312 faces the plate 309 of the upper panel tool 304. The top plate 312 directly contacts the top tank sheet 370 during the manufacturing process of the tank foam panels.

The lower panel tool 302 also has lower actuators 319 to move the side caps 376 (see side caps 76 in FIG. 8) of the tank foam panel 316. The lower actuators 319 can be ball screw linear actuators with integrated linear guides to move and position the caps 376 at a desired location based on a length of the tank foam panel 316. The lower panel tool 302 can also have a mechanical linkage 321 to move a drip insert 323 during the foaming process. The lower panel tool 302 can also have an edge support 315 that supports the longitudinal cap bracket of the tank 316.

Figure 21:
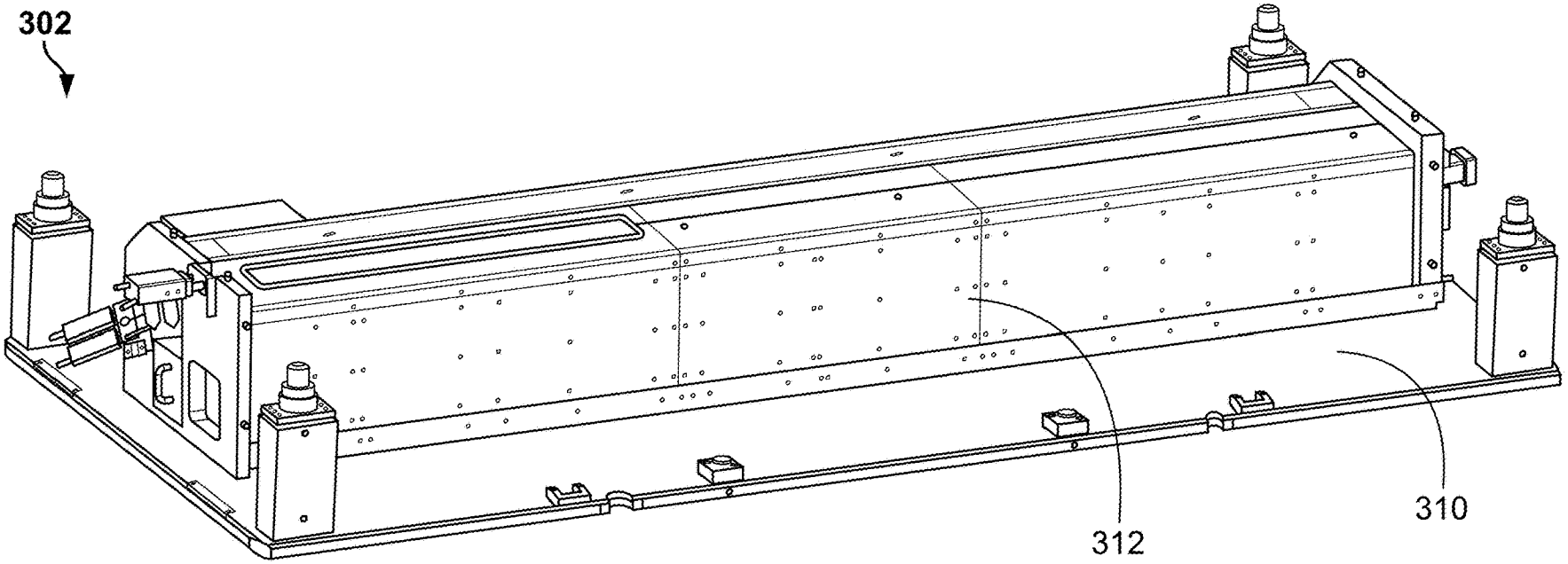
FIG. 21 is a perspective view of the lower panel tool in FIG. 20.
Figure 22:
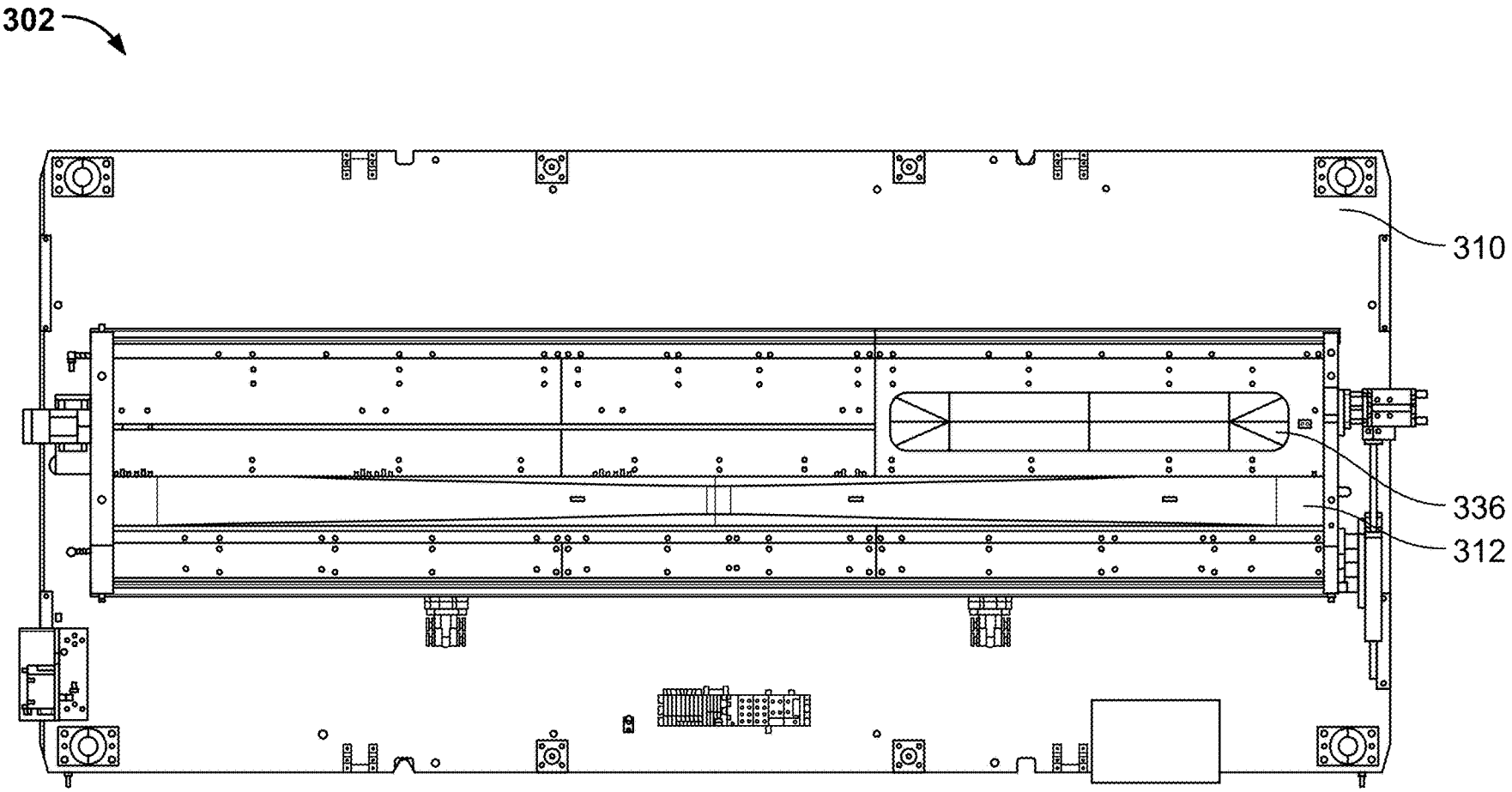
FIG. 22 is a top view of the lower panel tool in FIG. 21.

FIG. 21 illustrates a perspective view of the lower panel tool 302 and FIG. 22 illustrates a top view of the lower panel tool 302. Referring to FIGS. 21 and 22, the lower panel tool 302 has a vacuum surface 336 similar to the vacuum surface of the lower and upper panel tools in FIGS. 17 and 19. The vacuum surface is located on a top surface of the top plate 312 of the lower panel tool 302. The vacuum surface 326 has vacuum channels or holes that suck air to firmly grip the upper tank sheet and prevent the upper tank sheet from moving during the foaming process.

Figure 23:
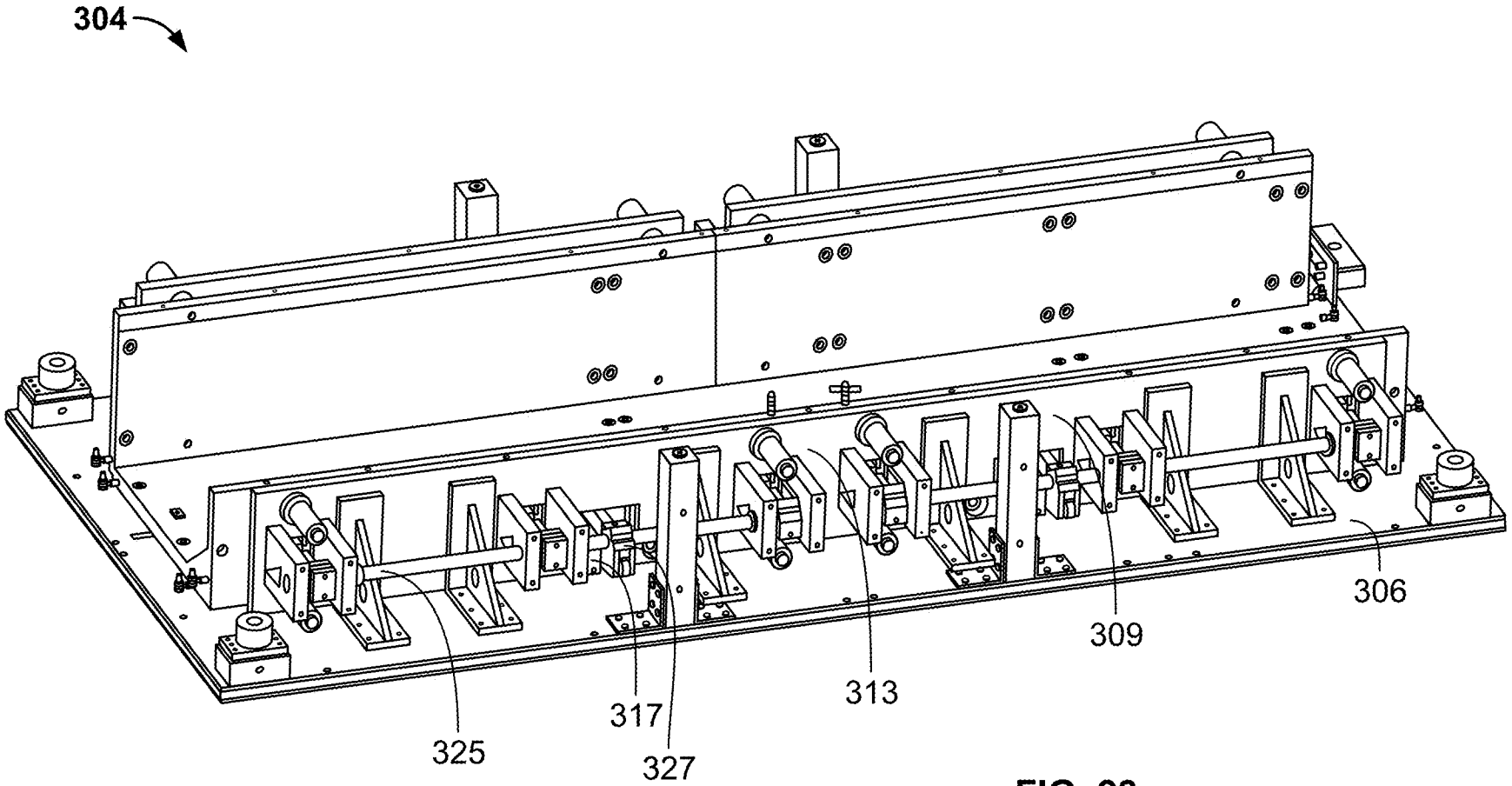
FIG. 23 is a perspective view of the upper panel tool in FIG. 20.

FIG. 23 is a perspective view of the upper panel tool 304. The upper panel tool 304 has a mechanical linkage 327 attached to the actuator 317. The mechanical linkage 327 moves a shaft 325 that pushes the walls 313 of the plate 309 of the upper panel tool 304. The shaft 325 allows the actuators 317 to uniformly move the walls 313 of the plate 309.

During the manufacturing process, a robotic arm (or a human operator) can move and assemble a 'frame' with the end brackets and longitudinal cap brackets on top of the upper sheet that is placed on top of the lower press tool 302. One of the end brackets has an aperture configured to receive foam from the foam nozzle. Once the frame is in place, the EOAT places the lower tank sheet on top of the frame, and the press presses the two sheets against the frame while the nozzle injects foam through the aperture into the volume between the sheets and the frame. The press can insert a plug into the aperture to close the volume after depositing the liquid foam. The end brackets and longitudinal cap brackets (the 'frame') bond to the foam to be part of the final assembly of the foam tank panel.

The chemical product (e.g., the liquid resin or foam) used in this process includes chemical characteristics or properties that are suitable to be used with the described equipment. For example, the chemical product can include an R-Value of 1.5 or more (e.g., R−1.55) for the foam panel to have the required energy efficiency and insulation properties for different applications. The chemical product can also have a demold time of about 5 minutes, which allows the manufacturing assembly (e.g., the assembly line) to run at target capacity (e.g., 40 units per day-shift) with a minimum number of equipment components.

Figure 24:
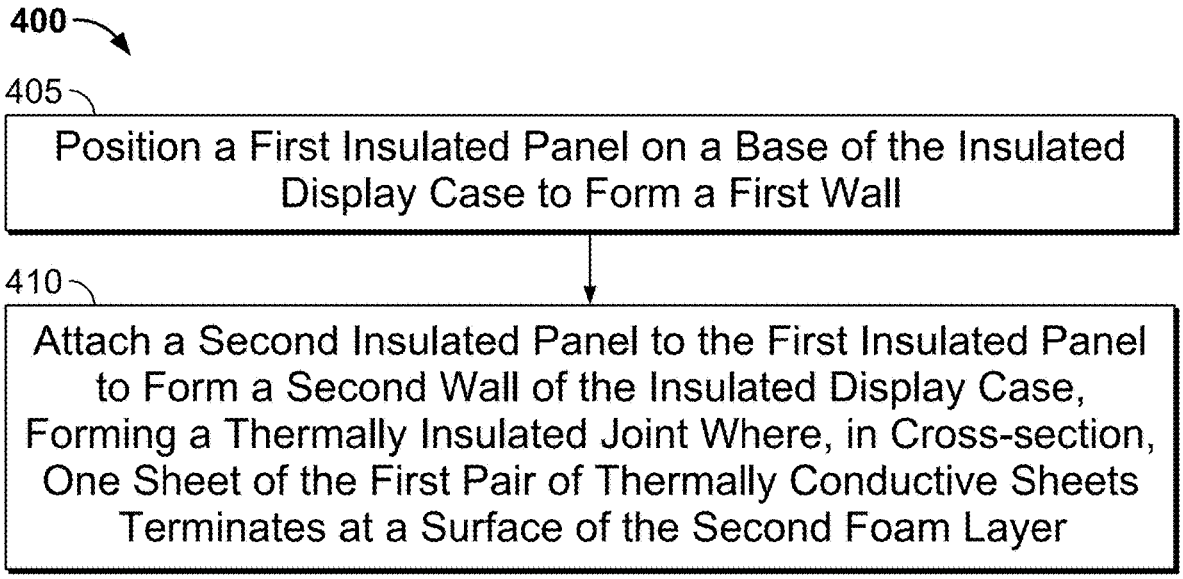
FIG. 24 is a flow chart of an example method of assembling an insulated display case.

FIG. 24 is a flow chart of an example method 400 of assembling an insulated display case. The method 400 includes positioning a first insulated panel on a base of the insulated display case to form a first wall (405). The method also includes attaching a second insulated panel to the first insulated panel to form a second wall of the insulated display case. The second insulated panel has a second foam layer sandwiched between a second pair of thermally conductive sheets, wherein attaching the second insulated panel to the first insulated panel comprises forming a thermally insulated joint where, in cross-section, one sheet of the first pair of thermally conductive sheets terminates at a surface of the second foam layer (410).

Figure 25:
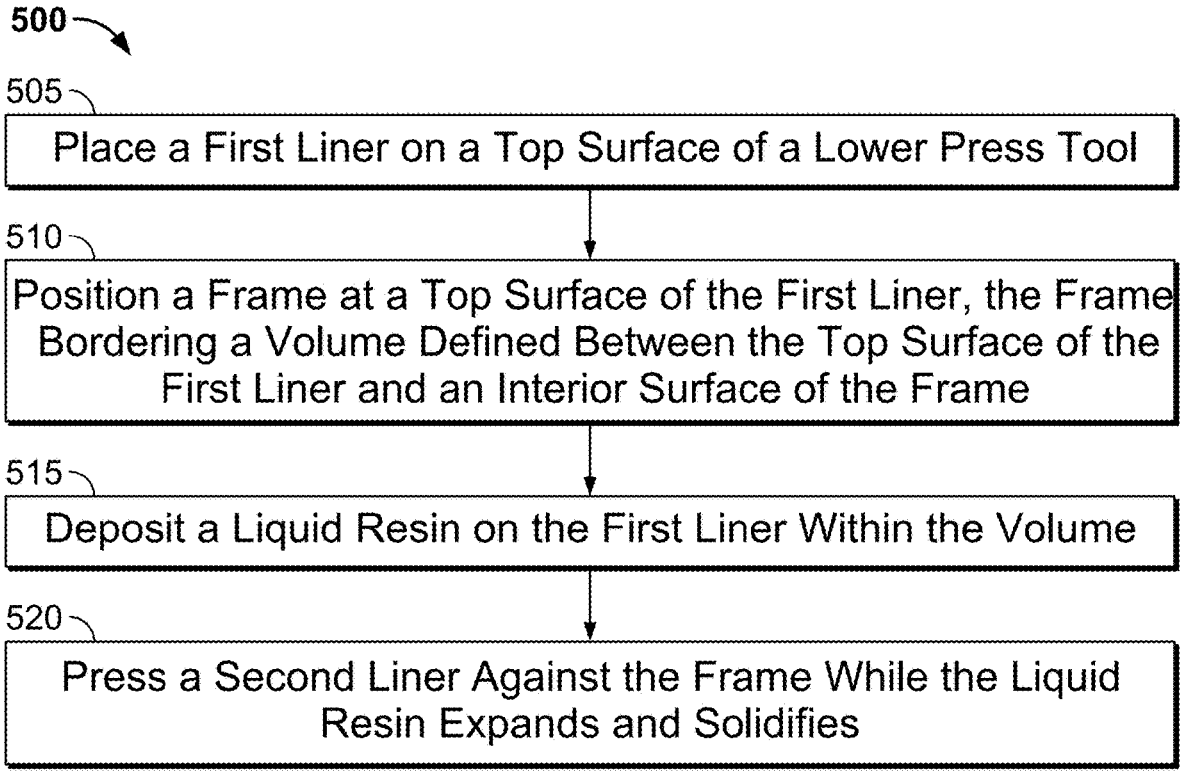
FIG. 25 is a flow chart of an example method of making an insulated foam panel.

FIG. 25 is a flow chart of an example method 500 of making an insulated foam panel. The method 500 includes placing a first liner on a top surface of a lower press tool (505). The method also includes positioning a frame at a top surface of the first liner, the frame bordering a volume defined between the top surface of the first liner and an interior surface of the frame (510). The method also includes depositing a liquid resin on the first liner within the volume (515). The method also includes pressing a second liner against the frame, the second liner overlaying the first liner while the liquid resin expands and solidifies into a foam between and bonded to the first liner and the second liner (520).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used herein, the terms "aligned," "substantially aligned," "parallel," or "substantially parallel" refer to a relation between two elements (e.g., lines, axes, planes, surfaces, or components) as being oriented generally along the same direction within acceptable engineering, machining, drawing measurement, or part size tolerances such that the elements do not intersect or intersect at a minimal angle. For example, two surfaces can be considered aligned with each other if surfaces extend along the same general direction of a device or component. Similarly, the terms "vertical," "substantially vertical," "horizontal," or "substantially horizontal" refer to a relation between two elements (e.g., lines, axes, planes, surfaces, or components) as being oriented generally at respective right angles within acceptable engineering, machining, drawing measurement, or part size tolerances such that the elements.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A refrigerated display case assembly, comprising:

a first insulated panel forming a first wall of the refrigerated display case assembly and comprising:

a first foam layer bounded by a first pair of sheets, and a first interface edge comprising a first non-flat cross-section; and a second insulated panel forming a second wall of the refrigerated display case assembly and comprising:

a second foam layer bounded by a second pair of sheets, and a second interface edge comprising a second non-flat cross-section corresponding with the first non-flat cross-section such that the second interface edge mates with the first interface edge to form a thermally insulated joint where, in cross-section, one sheet of the first pair of sheets terminates at the second foam layer of the second interface edge, with the second interface edge overlayed by the first insulated panel and a portion of the first foam layer at the first interface edge exposed, an internal sheet of the first pair of sheets terminates at a concave corner of the second interface edge;

wherein the first and second pair of sheets have a greater thermal conductivity than the first or second foam layers.

2. The refrigerated display case assembly of claim 1, wherein the exposed portion of the first foam layer of the first interface edge is flush with an external sheet of the second pair of sheets.

3. The refrigerated display case assembly of claim 1, wherein an external sheet of the second pair of sheets terminates at an end of the exposed portion of the first foam layer of the first interface edge.

4. The refrigerated display case assembly of claim 1, wherein the first non-flat cross-section is the same as the second non-flat cross-section such that an internal sheet of the second pair of sheets terminates at a surface of the internal sheet of the first pair of sheets.

5. The refrigerated display case assembly of claim 1, wherein the first insulated panel is arranged perpendicular with respect to the second insulated panel, and the insulated joint comprises a half-lap, corner joint.

6. The refrigerated display case assembly of claim 1, wherein the refrigerated display case assembly comprises a refrigerated display case chassis, the first insulating panel forms a back wall of the refrigerated display case chassis, and the second insulating panel forms a top of the refrigerated display case chassis.

7. The refrigerated display case assembly of claim 1, wherein the first and second pair of sheets comprise first and second pair of thermally conductive sheets made of metal.

8. A refrigerated display case assembly, comprising:

a first insulated panel forming a first wall of the refrigerated display case assembly and comprising:

a first foam layer bounded by a first pair of sheets, and a first interface edge comprising a first non-flat cross-section; and a second insulated panel forming a second wall of the refrigerated display case assembly and comprising:

a second foam layer bounded by a second pair of sheets, and a second interface edge comprising a second non-flat cross-section corresponding with the first non-flat cross-section such that the second interface edge mates with the first interface edge to form a thermally insulated joint where, in cross-section, one sheet of the first pair of sheets terminates at the second foam layer of the second interface edge, with the second interface edge overlayed by the first insulated panel and a portion of the first interface edge exposed, the first non-flat cross-section is the same as the second non-flat cross-section such that an internal sheet of the second pair of sheets terminates at a surface of an internal sheet of the first pair of sheets, and the internal sheet of the first pair of sheets terminates at a concave corner of the second interface edge;

wherein the first and second pair of sheets have a greater thermal conductivity than the first or second foam layers.

9. The refrigerated display case assembly of claim 8, wherein the exposed portion of the first interface edge is flush with an external sheet of the second pair of sheets.

10. The refrigerated display case assembly of claim 8, wherein an external sheet of the second pair of sheets terminates at an end of the exposed portion of the first interface edge.

11. The refrigerated display case assembly of claim 8, wherein the first insulated panel is arranged perpendicular with respect to the second insulated panel, and the insulated joint comprises a half-lap, corner joint.

12. The refrigerated display case assembly of claim 8, wherein the refrigerated display case assembly comprises a refrigerated display case chassis, the first insulating panel forms a back wall of the refrigerated display case chassis, and the second insulating panel forms a top of the refrigerated display case chassis.

13. The refrigerated display case assembly of claim 8, wherein the first and second pair of sheets comprise first and second pair of thermally conductive sheets made of metal.

* * * * *